US008127567B2

(12) United States Patent
Ogata et al.

(10) Patent No.: US 8,127,567 B2
(45) Date of Patent: Mar. 6, 2012

(54) SHAFT COUPLING AND ARRANGEMENT FOR FLUID MACHINE AND REFRIGERATION CYCLE APPARATUS

(75) Inventors: Takeshi Ogata, Osaka (JP); Hiroshi Hasegawa, Osaka (JP); Masaru Matsui, Kyoto (JP); Atsuo Okaichi, Osaka (JP); Tomoichiro Tamura, Kyoto (JP); Masanobu Wada, Osaka (JP)

(73) Assignee: Panasonic Corporation, Osaka (JP)

( * ) Notice: Subject to any disclaimer, the term of this patent is extended or adjusted under 35 U.S.C. 154(b) by 676 days.

(21) Appl. No.: 11/994,299

(22) PCT Filed: May 17, 2006

(86) PCT No.: PCT/JP2006/309864

§ 371 (c)(1),
(2), (4) Date: Dec. 28, 2007

(87) PCT Pub. No.: WO2007/000854

PCT Pub. Date: Jan. 4, 2007

(65) Prior Publication Data

US 2010/0107680 A1 May 6, 2010

(30) Foreign Application Priority Data

Jun. 29, 2005 (JP) ..... 2005-189404
Mar. 6, 2006 (JP) ..... 2006-059123

(51) Int. Cl.
*F25B 43/02* (2006.01)

(52) U.S. Cl. ..... 62/468

(58) Field of Classification Search ..... 62/468, 62/84, 469; 418/11, 60, 96; 417/410.5; 403/26, 403/195

See application file for complete search history.

(56) References Cited

U.S. PATENT DOCUMENTS

| | | | | |
|---|---|---|---|---|
| 4,644,207 | A | 2/1987 | Catterfeld et al. | |
| 5,022,146 | A | 6/1991 | Gannaway et al. | |
| 5,160,178 | A * | 11/1992 | Iwabuchi | 285/328 |
| 5,214,932 | A * | 6/1993 | Abdelmalek | 62/238.4 |
| 6,290,472 | B2 * | 9/2001 | Gannaway | 417/371 |
| 6,428,236 | B2 * | 8/2002 | Aota et al. | 403/359.5 |
| 6,666,036 | B2 * | 12/2003 | Matsuura | 62/114 |
| 2004/0005234 | A1 * | 1/2004 | Dreiman et al. | 417/559 |
| 2010/0263404 | A1 * | 10/2010 | Shiotani et al. | 62/468 |
| 2010/0269536 | A1 * | 10/2010 | Wada et al. | 62/402 |

FOREIGN PATENT DOCUMENTS

| | | |
|---|---|---|
| EP | 0 322 561 A2 | 5/1989 |
| JP | 9-126171 | 5/1997 |
| JP | 2004-316537 | 11/2004 |

* cited by examiner

*Primary Examiner* — Frantz Jules
*Assistant Examiner* — Lukas Baldridge
(74) *Attorney, Agent, or Firm* — Hamre, Schumann, Mueller & Larson, P.C.

(57) ABSTRACT

An oil supply passage (68) is formed inside a rotating shaft (56) of a compression mechanism (21). An oil supply passage (38) is formed inside a rotating shaft (36) of an expansion mechanism (22). A boss portion (81) is provided at a lower end of the rotating shaft (56). A shaft portion (82) that is engaged in the boss portion (81) is provided at an upper end of the rotating shaft (36). The circumference of a coupling part (80), which includes the boss portion (81) and the shaft portion (82) is covered by an upper bearing (42) of the expansion mechanism (22). The upper bearing (42) supports both the rotating shaft (36) and the rotating shaft (56).

15 Claims, 26 Drawing Sheets

SHAFT COUPLING AND ARRANGEMENT FOR FLUID MACHINE AND REFRIGERATION CYCLE APPARATUS

TECHNICAL FIELD

The present invention relates to a fluid machine furnished with a plurality of rotating mechanisms including a compression mechanism for compressing a fluid or an expansion mechanism for expanding a fluid. The invention also relates to a refrigeration cycle apparatus employing the fluid machine.

BACKGROUND ART

A fluid machine in which a plurality of rotating mechanisms are accommodated in a closed casing and the rotating shafts of the rotating mechanisms are coupled linearly to each other has been known, as disclosed on pp. 43-45 of "Strategic Development of Technology for Efficient Energy Utilization—Development of Two Phase Flow Expander/Compressor for a $CO_2$ Air Conditioner," a report issued in March 2003 by the New Energy and Industrial Technology Development Organization.

FIG. 27 is a view schematically illustrating the fluid machine disclosed in the just-mentioned document. As illustrated in FIG. 27, this fluid machine includes a vertically oblong closed casing 101 as well as a compression mechanism 102, a motor 103, and an expansion mechanism 104, which are accommodated in the closed casing 101. A recessed portion 105*a* having a regular hexagonal shape in cross section is formed in the upper end of a rotating shaft 105 of the compression mechanism 102. On the other hand, a protruding portion 106*a* having a regular hexagonal shape in cross section is formed at the lower end of a rotating shaft 106 of the expansion mechanism 104. By engagement of the protruding portion 106*a* and the recessed portion 105*a* with each other, the rotating shaft 105 and the rotating shaft 106 are coupled to each other. The recessed portion 105*a* and the protruding portion 106*a* together form a coupling part 107 for coupling the rotating shafts 105 and 106.

The compression mechanism 102 and the expansion mechanism 104 need to be supplied with lubricating oil. For this reason, an oil reservoir 112 for holding lubricating oil is provided in a bottom portion of the closed casing 101. An oil pump 115 is attached to a lower portion of the rotating shaft 105, and an oil supply passage 113 is formed inside the rotating shafts 105 and 106. With this configuration, the lubricating oil pumped up by the oil pump 115 is supplied through the oil supply passage 113 to sliding parts of the compression mechanism 102 and the expansion mechanism 104.

Reference numeral 108 denotes an intake pipe for taking in the fluid before compression, reference numeral 109 denotes a discharge pipe for discharging the fluid after compression, reference numeral 110 denotes an intake pipe for taking in the fluid before expansion, and reference numeral 111 denotes discharge pipe for discharging the fluid after expansion.

A similar fluid machine also is disclosed in JP 9-126171 A.

DISCLOSURE OF THE INVENTION

In the fluid machine, however, the rotating shaft 105 of the compression mechanism 102 and the rotating shaft 106 of the expansion mechanism 104 are coupled to each other merely at the coupling part 107, and therefore, the lubricating oil in the oil supply passage 113 may leak from the coupling part 107 (more specifically, from the gap between the recessed portion 105*a* and the protruding portion 106*a*). Thus, a problem is that the lubricating oil cannot be supplied stably to the upper rotating mechanism, i.e., to the expansion mechanism 104. Moreover, the lubricating oil that leaks out of the coupling part 107 tends to flow out through the discharge pipe 109 together with the fluid inside the closed casing 101. Consequently, a shortage in the amount of the lubricating oil inside the closed casing 101 may occur.

Normally, the compression mechanism 102 and the expansion mechanism 104 are welded to the closed casing 101. In the welding, a slight misalignment in the mounting positions of the compression mechanism 102 and the expansion mechanism 104 is inevitable. However, since the rotating shafts 105 and 106 have long lengths, the misalignment is exacerbated at the coupling part 107 of the rotating shafts 105 and 106. In view of this, in the fluid machine shown in FIG. 27, the coupling part 107 is allowed to have a margin taking the misalignment of the mounting positions of the compression mechanism 102 and the expansion mechanism 104 into consideration. In other words, a certain gap is provided in advance between the recessed portion 105*a* of the rotating shaft 105 and the protruding portion 106*a* of the rotating shaft 106. Therefore, a large amount of the lubricating oil tends to leak from the coupling part 107.

On the other hand, in the fluid machine disclosed in JP 9-126171 A, the two rotating shafts are coupled by a joint. In order to allow the rotating shafts to rotate smoothly, it is necessary to provide an appropriate gap between the joint and the rotating shafts so that the gap can absorb the misalignment of the mounting positions and thermal deformation of the mechanisms. Thus, this joint for coupling the rotating shafts does not contribute to prevention of the oil leak, or rather worsens the oil leak. Although there may seem to be a proposal of reducing the gap between the joint and the rotating shafts in order to prevent the oil leak, such a configuration may result in poorer assemblability and make the effect of absorbing the misalignment of the mounting positions and thermal deformation of the mechanisms insufficient.

The present invention has been accomplished in view of such circumstances, and it is an object of the invention to supply lubricating oil stably to the rotating mechanisms in a fluid machine in which the rotating shafts of a plurality of rotating mechanisms are coupled linearly to each other. It is another object of the present invention to prevent the lubricating oil from flowing out of the closed casing.

Accordingly, the present invention provides a fluid machine including:

a first rotating mechanism including a compression mechanism for compressing a fluid or an expansion mechanism for expanding a fluid, the compression mechanism and the expansion mechanism having a first rotating shaft in which a first oil supply passage extending axially is formed;

a second rotating mechanism including a compression mechanism for compressing a fluid or an expansion mechanism for expanding a fluid, the compression mechanism and the expansion mechanism having a second rotating shaft in which a second oil supply passage extending axially is formed, the second rotating shaft being coupled linearly to the first rotating shaft so that lubricating oil is allowed to flow through the first oil supply passage and the second oil supply passage;

a closed casing for accommodating the first and second rotating mechanisms; and a bearing for supporting at least one of the first and second rotating shafts, and covering a circumference of a coupling part of the first rotating shaft and the second rotating shaft in the closed casing.

In the just-described fluid machine, the circumference of the coupling part of the first rotating shaft and the second rotating shaft is covered by the bearing. As a result, the oil leak from the coupling part is suppressed. Therefore, the lubricating oil can be supplied stably to various rotating mechanisms. Moreover, since the oil leak from the coupling part is suppressed, it is possible to prevent the lubricating oil from flowing out of the closed casing. Furthermore, according to the just-described fluid machine, even if the lubricating oil leaks from the coupling part, that lubricating oil is utilized effectively for the lubrication and sealing inside the bearing. What is more, according to the just-described fluid machine, the coupling part is supported by the bearing, and therefore, both of the rotating shafts can be supported stably.

In another aspect, the present invention provides a fluid machine including:

a first rotating mechanism including a compression mechanism for compressing a fluid or an expansion mechanism for expanding a fluid, the compression mechanism and the expansion mechanism having a first rotating shaft in which a first oil supply passage extending axially is formed;

a second rotating mechanism including a compression mechanism for compressing a fluid or an expansion mechanism for expanding a fluid, the compression mechanism and the expansion mechanism having a second rotating shaft in which a second oil supply passage extending axially is formed;

a bearing for supporting at least one of the first and second rotating shafts rotatably;

a closed casing for accommodating the first rotating mechanism, the second rotating mechanism, and the bearing; and a coupling member disposed inside the bearing, for coupling the first rotating shaft and the second rotating shaft and connecting the first oil supply passage and the second oil supply passage by bringing the first and second rotating shafts into engagement with each other.

According to the just-described fluid machine, the assemblability of the rotating mechanisms improves because the rotating shaft of the first rotating mechanism (the first rotating shaft) and the rotating shaft of the second rotating mechanism (the second rotating shaft) are separate components. Moreover, the coupling member is disposed inside the bearing and is covered by the bearing. Therefore, the lubricating oil does not leak from the gap between the coupling member and the rotating shafts easily. Thus, the lubricating oil can be supplied stably to both of the rotating mechanisms. Moreover, since the oil leak is suppressed, it is possible to prevent the lubricating oil from flowing out of the closed casing. Furthermore, according to the just-described fluid machine, the lubricating oil leaking from the just-mentioned gap is supplied to portions that intrinsically require lubricating oil, i.e., between the bearing and the rotating shafts, and therefore is utilized effectively for lubrication and sealing of the bearing.

The above-described fluid machines may be applied to a refrigeration cycle apparatus, which constitutes the substantial part of air conditioners or hot water heaters.

Accordingly, the present invention provides a refrigeration cycle apparatus including: an expander-compressor unit including a compression mechanism for compressing a refrigerant, a motor for supplying mechanical power to the compression mechanism, an expansion mechanism for expanding the refrigerant, and a shaft for coupling the compression mechanism and the expansion mechanism; a radiator for cooling the refrigerant; and an evaporator for evaporating the refrigerant, wherein the expander-compressor unit is constituted by the aforementioned fluid machine in which the first rotating mechanism is the compression mechanism and the second rotating mechanism is the expansion mechanism.

BEST MODE FOR CARRYING OUT THE INVENTION

Hereinbelow, embodiments of the present invention are described in detail with reference to the drawings.

First Embodiment

Figure 1:
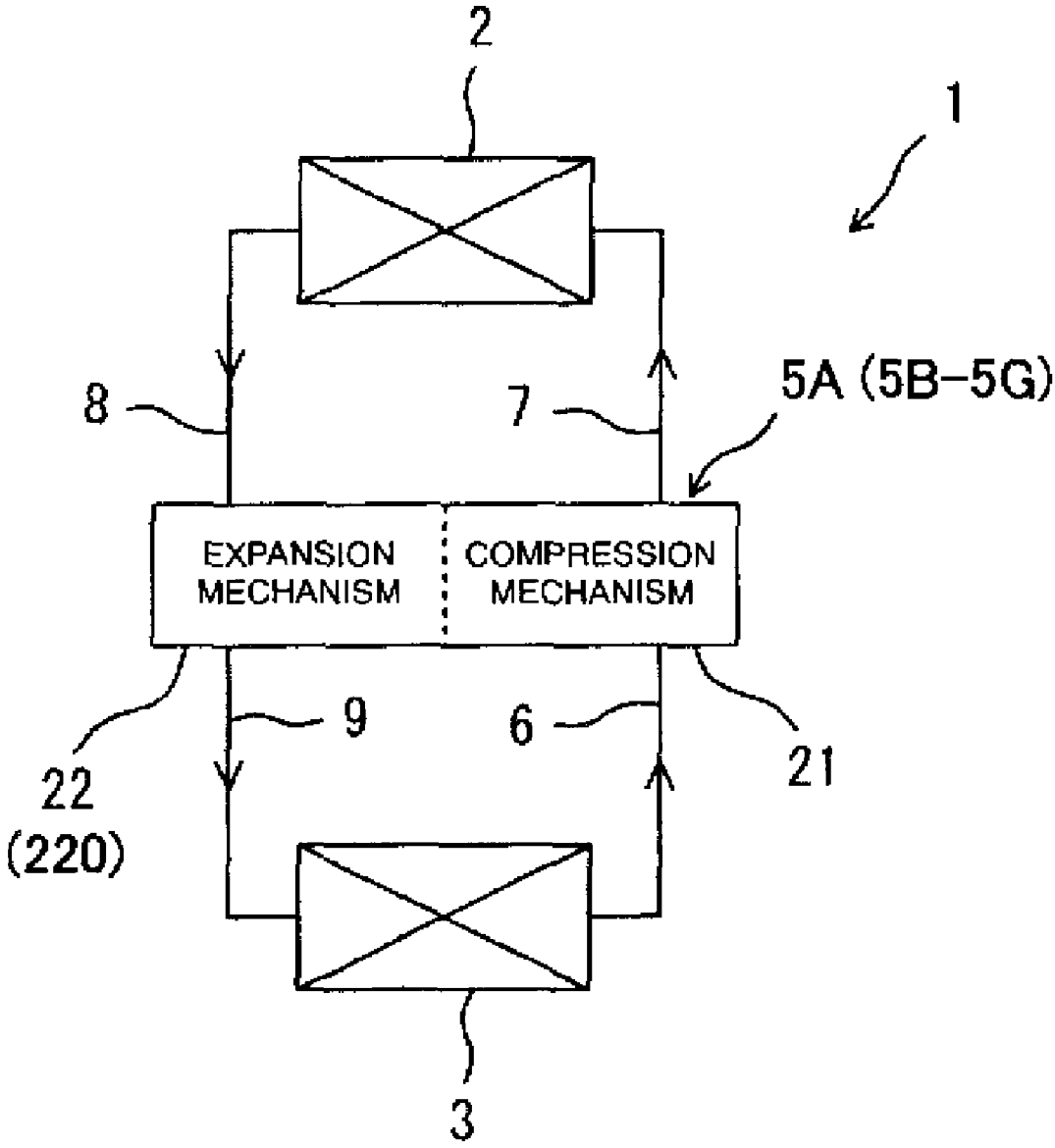
FIG. 1 is a refrigerant circuit diagram in which a fluid machine according to an embodiment is incorporated.

As illustrated in FIG. 1, a fluid machine 5A according to the present embodiment is incorporated as an expander-compressor unit in a refrigerant circuit of a refrigeration cycle apparatus 1. The fluid machine 5A includes a compression mechanism 21 (first rotating mechanism) for compressing refrigerant, and an expansion mechanism 22 (second rotating mechanism) for expanding refrigerant. The compression mechanism 21 is connected to an evaporator 3 via an intake pipe 6, and also connected to a radiator 2 via a discharge pipe 7. The expansion mechanism 22 is connected to the radiator 2 via an intake pipe 8, and also connected to the evaporator 3 via a discharge pipe 9.

This refrigerant circuit is filled with such a refrigerant that it reaches a supercritical state in the high-pressure portion (i.e., the portion from the compressor 21 via the radiator 2 to the expansion mechanism 20). In the present embodiment, carbon dioxide ($CO_2$) is used as such a refrigerant. It should be noted, however, that the type of the refrigerant is not particularly limited, and it may be such a refrigerant that does not reach a supercritical state during operation (such as fluorocarbon-based refrigerants).

The refrigerant circuit in which the fluid machine 5A is to be incorporated is not limited to a refrigerant circuit in which the refrigerant circulates in only one direction. The fluid machine 5A may be provided in a refrigerant circuit in which the circulation direction of the refrigerant may be changed. For example, the fluid machine 5A may be provided in a refrigerant circuit that has a four-way valve and is thereby capable of performing a heating operation and a cooling operation.

Figure 2:
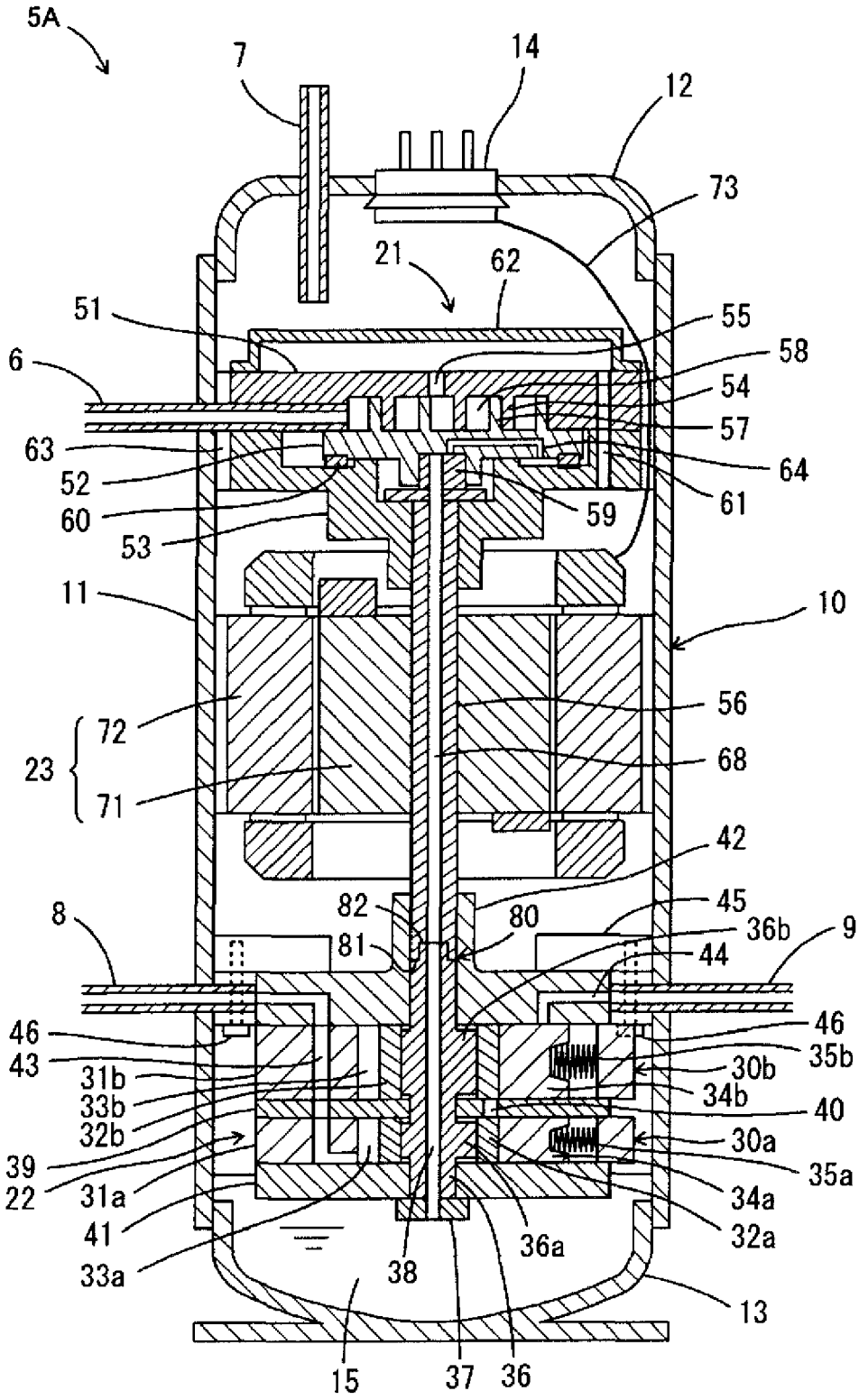
FIG. 2 is a vertical cross-sectional view of the fluid machine.

As illustrated in FIG. 2, the compression mechanism 21 and the expansion mechanism 22 of the fluid machine 5A are accommodated in the interior of a closed casing 10. The expansion mechanism 22 is disposed below the compression mechanism 21, and a motor 23 is provided between the compression mechanism 21 and the expansion mechanism 22.

The closed casing 10 includes a cylindrical body 11, the top and bottom ends of which are open, a top lid 12 for closing the top end of the cylindrical body 11, and a bottom lid 13 for closing the bottom end of the cylindrical body 11. The top lid 12 and the cylindrical body 11 as well as the bottom lid 13 and the cylindrical body 11 are joined respectively by welding or the like. A terminal 14 to which electric cables or the like are connected is fixed to the top lid 12. An oil reservoir 15 for holding lubricating oil is formed in a bottom portion of the closed casing 10. The compression mechanism 21 and the expansion mechanism 22 are arranged along a longitudinal direction of the closed casing 10, in other words, in a vertical direction.

First, the configuration of the expansion mechanism 22 will be described. The expansion mechanism 22 is of a rotary type and includes a first expansion section 30*a* and a second expansion section 30*b*. The first expansion section 30*a* is disposed below the second expansion section 30*b*.

The first expansion section 30*a* has a substantially cylindrically shaped cylinder 31*a* and a cylindrically shaped piston 32*a* inserted in the cylinder 31*a*. A first expansion chamber 33*a* is formed between the inner circumferential surface of the cylinder 31*a* and outer circumferential surface of the piston 32*a*. A radially extending vane groove is formed in the cylinder 31*a*, and a vane 34*a* and a spring 35*a* for biasing the vane 34*a* toward the piston 32*a* is provided in the vane groove. The vane 34*a* divides the first expansion chamber 33*a* into a high-pressure side expansion chamber and a low-pressure side expansion chamber.

The second expansion section 30*b* has almost the same configuration as the first expansion section 30*a*. Specifically, the second expansion section 30*b* has a substantially cylindrically shaped cylinder 31*b*, a cylindrically shaped piston 32*b* inserted in the cylinder 31*b*, a vane 34*b* provided in a vane groove of the cylinder 31*b*, and a spring 35*b* for biasing the vane 34*b* toward the piston 32*b*. A second expansion chamber 33*b* is formed between the inner circumferential surface of the cylinder 31*b* and outer circumferential surface of the piston 32*b*.

The expansion mechanism 22 includes a rotating shaft 36 (second rotating shaft) having a first eccentric portion 36*a* and a second eccentric portion 36*b*. The first eccentric portion 36*a* is inserted slidably in the piston 32*a*, and the second eccentric portion 36*b* is inserted slidably in the piston 32*b*. Thereby, the piston 32*a* is regulated to revolve within the cylinder 31*a* in an off-centered state by the first eccentric portion 36*a*. Likewise, the piston 32*b* is regulated to revolve within the cylinder 31*b* in an off-centered state by the second eccentric portion 36*b*.

The lower end of the rotating shaft 36 is immersed in the lubricating oil in the oil reservoir 15. An oil pump 37 for pumping up the lubricating oil is provided at the lower end of the rotating shaft 36. An oil supply passage 38 extending axially is formed inside the rotating shaft 36. It should be noted that the phrase "axially extending" means that the object seen as a whole extends axially (vertically) as a whole. Therefore, it does not mean only the case in which the object extends axially linearly but it also include such cases in which the object extends spirally. Although not shown in the drawings, the rotating shaft 36 is provided with an oil supply port (for example, a hole connecting the oil supply passage 38 and sliding parts and extending in a radial direction of the rotating shaft 36) for supplying the lubricating oil in the oil supply passage 38 to sliding parts of the expansion mechanism 22.

The first expansion section 30*a* and the second expansion section 30*b* are partitioned by a partition plate 39. The partition plate 39 covers an area above the cylinder 31*a* and the piston 32*a* of the first expansion section 30*a*, and defines the first expansion chamber 33*a*. Also, the partition plate 39 covers an area below the cylinder 31*b* and the piston 32*b* of the second expansion section 30*b*, and defines the second expansion chamber 33*b*. A through hole 40 for connecting the first expansion chamber 33*a* and the second expansion chamber 33*b* is formed in the partition plate 39. It should be noted that the first expansion chamber 33*a* and the second expansion chamber 33*b* may be separate expansion chambers, each of which expands the refrigerant separately. However, in the present embodiment, these expansion chambers 33*a* and 33*b* form one expansion chamber through the though hole 40. In other words, in the present embodiment, the refrigerant expands in the first expansion chamber 33*a* and the second expansion chamber 33*b* continuously.

A lower bearing 41 is provided below the first expansion section 30*a*. The lower bearing 41 supports the lower end of the rotating shaft 36. In addition, the lower bearing 41 closes the bottom of the cylinder 31*a* and the piston 32*a* of the first expansion section 30*a* and defines the lower side of the first expansion chamber 33*a*.

An upper bearing 42 is provided above the second expansion section 30*b*. The upper bearing 42 supports the rotating shaft 36 (second rotating shaft) of the expansion mechanism 22 and a rotating shaft 56 (first rotating shaft) of the compression mechanism 21, the details of which will be described later. In addition, the upper bearing 42 closes the top of the cylinder 31*b* and the piston 32*b* of the second expansion section 30*b*, and defines the upper side of the second expansion chamber 33*b*.

An intake passage 43 for guiding the refrigerant from the intake pipe 8 to the first expansion chamber 33*a* is formed in the upper bearing 42, the cylinder 31*b*, the partition plate 39, and the cylinder 31*a*. The intake pipe 8, piercing through the cylindrical body 11 of the closed casing 10, is connected to the upper bearing 42. A discharge passage 44 for guiding the refrigerant, which has expanded in the second expansion chamber 33*b*, to the discharge pipe 9 is formed in the upper bearing 42. The discharge pipe 9, piercing through the cylindrical body 11 of the closed casing 10, is connected to the upper bearing 42.

A mounting member 45 is joined to the inner wall of the cylindrical body 11 of the closed casing 10 by welding or the like. The upper bearing 42 is fastened to the mounting member 45 by bolts 46. It should be noted that the lower bearing 41, the first expansion section 30*a*, the partition plate 39, the second expansion section 30*b*, and the upper bearing 42 of the expansion mechanism 22 are assembled integrally in advance. As a result, by bolt fastening the upper bearing 42 to the mounting member 45, the entire expansion mechanism 22 is secured to the mounting member 45.

Next, the configuration of the compression mechanism 21 will be described. The compression mechanism 21 is of a scroll type, and includes a stationary scroll 51, a movable scroll 52 axially opposing the stationary scroll 51, a rotating shaft 56 for supporting the movable scroll 52, and a bearing 53 for supporting the rotating shaft 56.

A lap 54 in a scroll shape (such as an involute shape) and a discharge port 55 are formed in the stationary scroll 51. A lap 57 that meshes with the lap 54 of the stationary scroll 51 is formed in the movable scroll 52. A scroll compression chamber 58 is formed between the lap 54 and the lap 57. An eccentric portion 59 is formed at an upper end of the rotating shaft 56, and the movable scroll 52 is supported on the eccentric portion 59. As a result, the movable scroll 52 revolves in an off-centered state from the shaft center of the rotating shaft 56. An Oldham ring 60 for preventing rotation of the movable scroll 52 is disposed below the movable scroll 52. An oil supply port 64 is formed in the movable scroll 52.

A cover 62 is provided on top of the stationary scroll 51. A discharge passage 61 extending vertically, for circulating the refrigerant, is provided in the stationary scroll 51 and the bearing 53. A circulating passage 63 extending vertically, for circulating the refrigerant, is formed outside the stationary scroll 51 and the bearing 53. With such a configuration, the refrigerant discharged from the discharge port 55 is discharged into the space within the cover 62 temporarily, and discharged below the compression mechanism 21 through the discharge passage 61. The refrigerant discharged below the compression mechanism 21 is guided through the circulating passage 63 above the compression mechanism 21.

The intake pipe 6, piercing through the cylindrical body 11 of the closed casing 10, is connected to the stationary scroll 51. The discharge pipe 7 is connected to the top lid 12 of the closed casing 10. One end of the discharge pipe 7 opens toward the space above the compression mechanism 21 in the closed casing 10.

The compression mechanism 21 is joined to the inner wall of the cylindrical body 11 of the closed casing 10 by welding or the like.

The rotating shaft 56 of the compression mechanism 21 extends downwardly. An oil supply passage 68 extending axially is formed inside the rotating shaft 56 as well as in the rotating shaft 36 of the expansion mechanism 22.

The motor 23 is constituted by a rotor 71, which is fixed to a mid portion of the rotating shaft 56, and a stator 72 disposed at an outer circumferential side of the rotor 71. The stator 72 is fixed to the inner wall of the closed casing 10 of the cylindrical body 11. The stator 72 is connected to a terminal 14 through a motor wire 73. By this motor 23, the rotating shaft 56 is driven.

The rotating shaft 56 of the compression mechanism 21 and the rotating shaft 36 of the expansion mechanism 22 are coupled linearly to each other at a coupling part 80. In the present embodiment, the coupling part 80 has an engagement structure. Specifically, a boss portion 81 that is recessed upwardly is formed as a first engaging portion at the lower end of the rotating shaft 56. On the other hand, a shaft portion 82 that protrudes upwardly is formed as a second engaging portion at the upper end of the rotating shaft 36. The first engaging portion and the second engaging portion engages with each other, in other words, the shaft portion 82 engages with the boss portion 81, whereby the two rotating shafts 36 and 56 are coupled to each other. This enables the lubricating oil to flow through the oil supply passage 68 and the oil supply passage 38.

Figure 3:
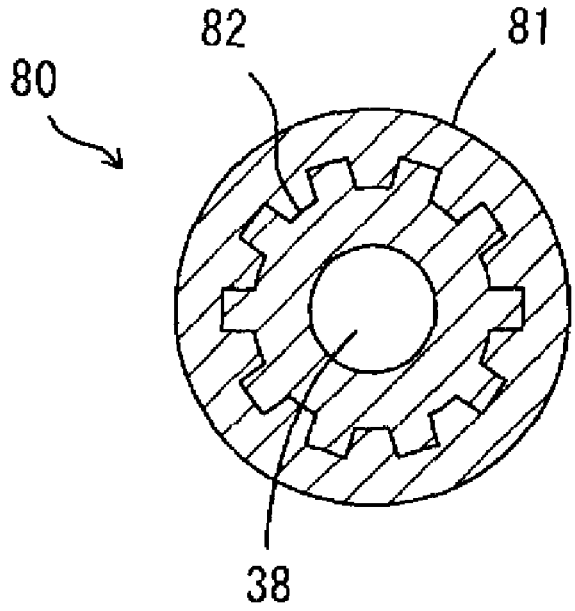
FIG. 3 is a horizontal cross-sectional view of a coupling part.

In the present embodiment, the shaft portion 82 has what is called a spline shape, in which a plurality of grooves (teeth) are provided in its outer circumferential side, as illustrated in FIG. 3. Likewise, a plurality of grooves corresponding to the grooves of the shaft portion 82 are formed in the inner circumferential side of the boss portion 81.

Figure 4:
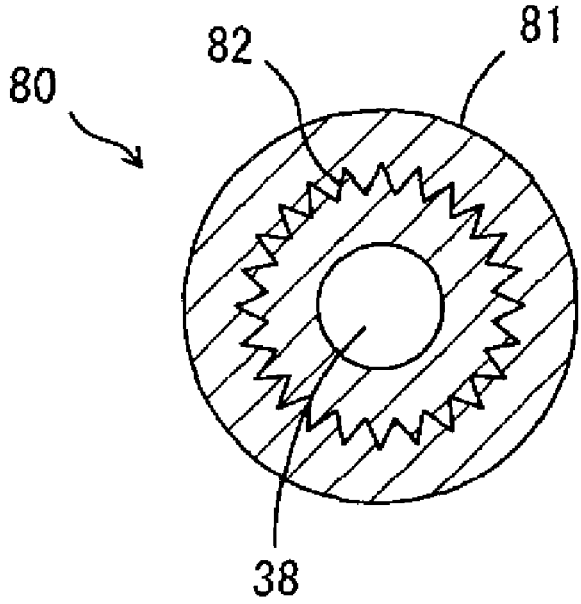
FIG. 4 is a horizontal cross-sectional view of a coupling part according to a modified example.

It should be noted, however, that the specific shapes of the shaft portion 82 and the boss portion 81 are not limited in any way. For example, as illustrated in FIG. 4, the shaft portion 82 may have what is called a serration shape, in which smaller teeth are provided in its outer circumferential side, and the inner circumferential side of the boss portion 81 may have smaller grooves corresponding to the serration shape of the shaft portion 82.

Figure 5:
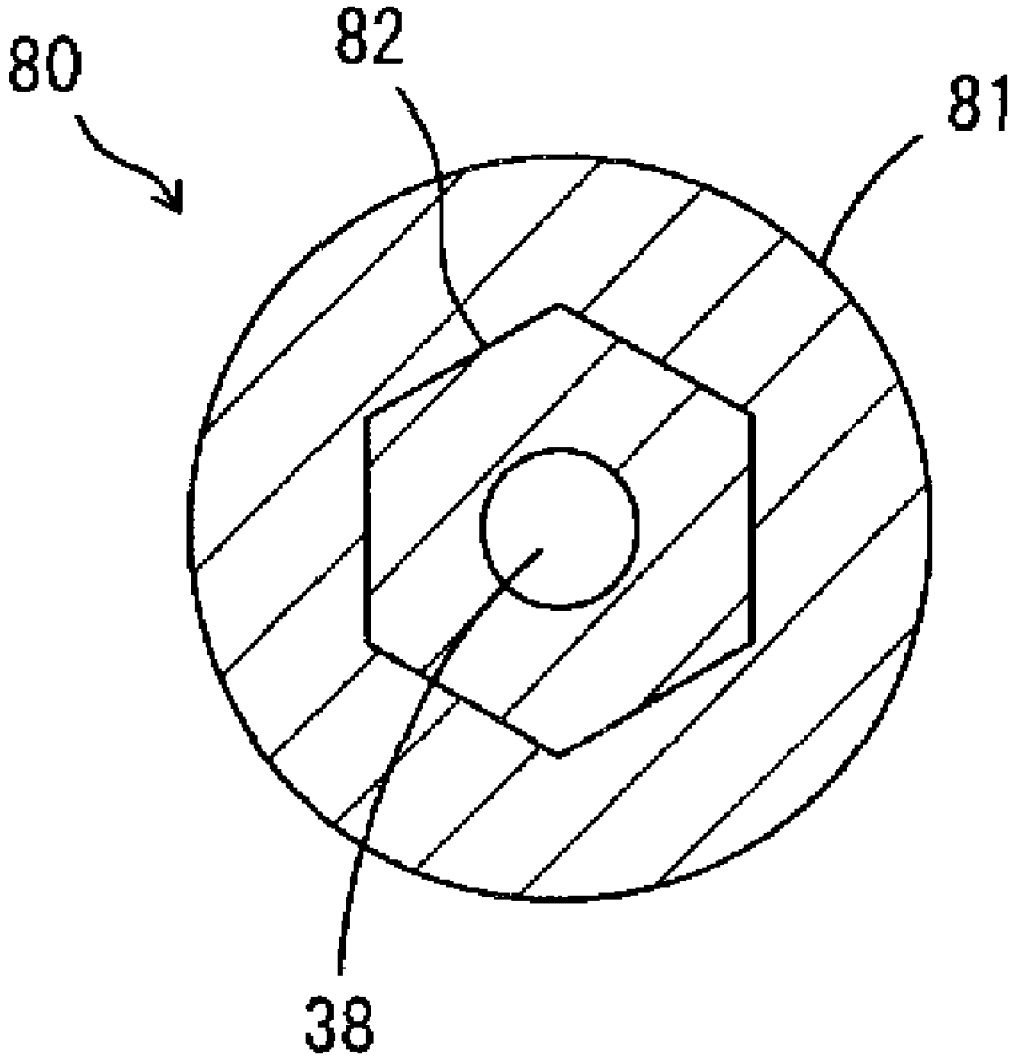
FIG. 5 is a horizontal cross-sectional view of a coupling part according to another modified example.

Alternatively, as illustrated in FIG. 5, the outer circumferential contour of the shaft portion 82 may be formed in a hexagonal shape in its cross section perpendicular to the axis direction, and the inner circumferential contour of the boss portion 81 may be formed in a hexagonal shape corresponding to the just-described the shaft portion 82. Alternatively, although not shown in the drawings, the outer circumferential contour of the shaft portion 82 may be formed in a polygonal shape other than the hexagonal shape, and the inner circumferential contour of the boss portion 81 may be formed in a polygonal shape corresponding to the just-described the shaft portion 82.

In the present embodiment, the boss portion 81 is provided in the rotating shaft 56 of the compression mechanism 21 and the shaft portion 82 is provided in the rotating shaft 36 of the expansion mechanism 22. Conversely, the shaft portion 82 may be provided in the rotating shaft 56 of the compression mechanism 21 and the boss portion 81 may be provided in the rotating shaft 36 of the expansion mechanism 22.

As illustrated in FIG. 2, the oil supply passage 38 of the rotating shaft 36 and the oil supply passage 68 of the rotating shaft 56 extend vertically and are connected at the coupling part 80. The upper bearing 42 supports an upper side of the rotating shaft 36 and a lower side of the rotating shaft 56. Accordingly, the upper side of the rotating shaft 36 and the lower side of the rotating shaft 56 are covered integrally with the upper bearing 42. Thus, the circumference of the coupling part 80 is covered by the upper bearing 42.

Figure 6A:
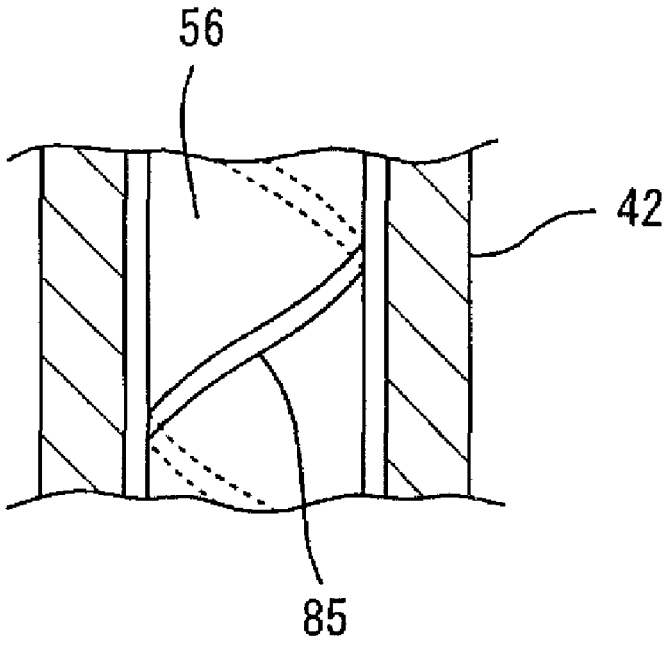
FIG. 6A is a partially enlarged view of an upper bearing and a rotating shaft.
Figure 6B:
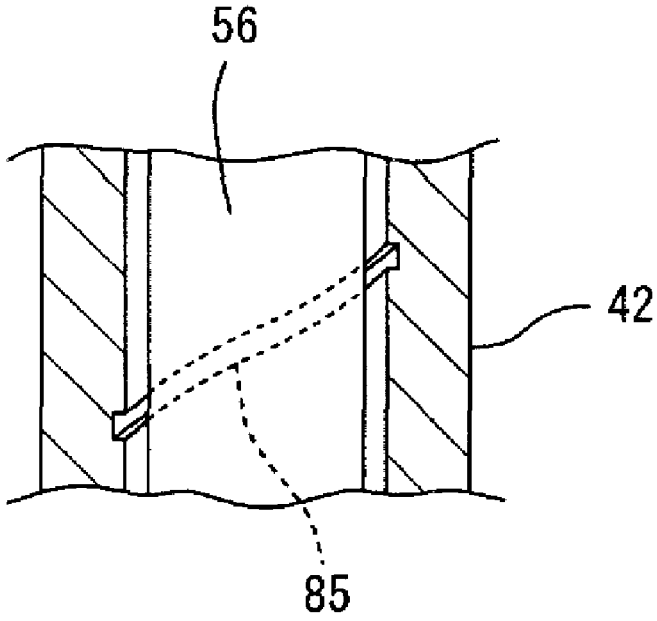
FIG. 6B is a partially enlarged view of an upper bearing and a rotating shaft according to a modified example.

A spiral shaped oil supply groove is formed in a sliding part between the upper bearing 42 and the two rotating shafts 36 and 56. In the present embodiment, a spiral shaped oil supply groove 85 is formed in the outer circumferential surface of the rotating shaft 56 within the upper bearing 42, as illustrated in FIG. 6A. In addition, although not shown in the drawings, a similar spiral shaped oil supply groove is formed in the outer circumferential surface of the rotating shaft 36 within the upper bearing 42. It should be noted, however, that the oil supply groove 85 may be formed in the inner circumferential surface of the upper bearing 42, as illustrated in FIG. 6B. It is also possible to provide the oil supply groove 85 both in inner circumferential surface of the upper bearing 42 and in the outer circumferential surfaces of the two rotating shafts 36 and 56.

Next, the operation of the fluid machine 5A will be described below. In this fluid machine 5A, the rotating shaft 56 and the rotating shaft 36 rotate integrally with each other when the motor 23 is driven.

In the compression mechanism 21, the movable scroll 52 revolves in association with rotation of the rotating shaft 56. Thereby, refrigerant is taken in from the intake pipe 6. The low pressure refrigerant that has been taken in is compressed in the compression chamber 58 to become a high pressure refrigerant, and thereafter is discharged from the discharge port 55. The refrigerant discharged from the discharge port 55 is guided through the discharge passage 61 and the circulating passage 63 to a region above the compression mechanism 21, and is discharged through the discharge pipe 7 to the outside of the closed casing 10.

In the expansion mechanism 22, the pistons 32*a* and 32*b* revolve in association with rotation of the rotating shaft 36. Thereby, the high pressure refrigerant that has been taken in from the intake pipe 8 flows into the first expansion chamber 33*a* through the intake passage 43. The high pressure refrigerant that has flowed into the first expansion chamber 33*a* is expanded in the first expansion chamber 33*a* and the second expansion chamber 33*b* to be turned into a low pressure refrigerant. This low pressure refrigerant flows through the discharge passage 44 into the discharge pipe 9 and is discharged through the discharge pipe 9 to the outside of the closed casing 10.

The lubricating oil in the oil reservoir 15 is pumped up by the oil pump 37 in association with rotation of the rotating shaft 36, and rises in the oil supply passage 38 of the rotating shaft 36. The lubricating oil in the oil supply passage 38 is supplied through an oil supply port, which is not shown in the drawings, to sliding parts of the expansion mechanism 22 and is supplied further to a sliding part between the rotating shaft 36 and the upper bearing 42. The lubricating oil performs lubrication and sealing of these sliding parts.

The lubricating oil that has risen through the oil supply passage 38 passes through the coupling part 80 and flows into the oil supply passage 68 of the rotating shaft 56. A portion of the lubricating oil that has flown into the oil supply passage 68 is supplied through an oil supply port to the sliding part between the rotating shaft 56 and the upper bearing 42 to perform lubrication and sealing of the sliding part. The other portion of the lubricating oil in the oil supply passage 68 moves upward in the oil supply passage 68, and is guided to the compression mechanism 21. The just-mentioned lubricating oil performs lubrication and sealing of the sliding parts of the compression mechanism 21.

Here, because the rotating shaft 56 of the compression mechanism 21 and the rotating shaft 36 of the expansion mechanism 22 are separate members from each other, there is a slight gap in the coupling part 80 of the rotating shaft 56 and the rotating shaft 36. However, the oil leak from the coupling part 80 is suppressed because the circumference of the coupling part 80 is covered by the upper bearing 42. The coupling part 80 is also a sliding part that requires lubricating oil because it is located inside the upper bearing 42. This means that, even if the lubricating oil leaks from the coupling part 80, that lubricating oil is utilized effectively for the lubrication and sealing inside the upper bearing 42. After moving upward within the upper bearing 42, the lubricating oil in the upper bearing 42 flows out from the upper end of the upper bearing 42 and thereafter flows down along the outer side of the upper bearing 42 or the like, so that the lubricating oil is recovered into the oil reservoir 15.

Next, a method of assembling the fluid machine 5A will be described below.

In assembling the fluid machine 5A, first, the cylindrical body 11 of the closed casing 10 is prepared, and the stator 72 of the motor 23 and the mounting member 45 are joined to the inner wall of the cylindrical body 11. Next, the compression mechanism 21 in which the rotor 71 is fixed to the rotating shaft 56 is inserted from one end (the upper end of FIG. 2) of the cylindrical body 11 and the compression mechanism 21 is joined to the inner wall of the cylindrical body 11. Next, the expansion mechanism 22 is inserted from the other end (the lower end of FIG. 2) of the cylindrical body 11, and the shaft portion 82 of the rotating shaft 36 is engaged with the boss portion 81 of the rotating shaft 56, whereby the rotating shaft 36 and the rotating shaft 56 are coupled to each other. Thereafter, the expansion mechanism 22 is fastened to the mounting member 45 by bolts 46.

Next, the intake pipe 6 is inserted from outside of the cylindrical body 11 and the intake pipe 6 is joined to the compression mechanism 21 and the cylindrical body 11. In addition, the intake pipe 8 and the discharge pipe 9 are inserted from outside of the cylindrical body 11, and the intake pipe 8 and the discharge pipe 9 are joined to the expansion mechanism 22 and the cylindrical body 11. Thereafter, the top lid 12 is joined to one end of the cylindrical body 11, and the bottom lid 13 is joined to the other end of the cylindrical body 11. Then, the discharge pipe 7 is inserted from outside of the top lid 12, and the discharge pipe 7 is joined to the top lid 12.

As is apparent from the foregoing, according to the present embodiment, the circumference of the coupling part 80 is covered by the upper bearing 42. Therefore, the oil leak from the coupling part 80 can be prevented. Accordingly, the lubricating oil also can be supplied stably to the compression mechanism 21, which is the rotating mechanism located above. In other words, stable oil supply can be realized for both of the compression mechanism 21 and the expansion mechanism 22.

Moreover, since the oil leak from the coupling part 80 can be prevented, it is possible to prevent the lubricating oil from flowing out of the closed casing 10 from the discharge pipe 7 together with the refrigerant. Thus, a shortage of lubricating oil in the closed casing 10 can be prevented.

Furthermore, according to the present embodiment, even if the lubricating oil leaks from the coupling part 80, that lubricating oil is utilized effectively for the lubrication and sealing inside the upper bearing 42. For this reason, no wasteful oil leak occurs.

Furthermore, according to the present embodiment, there is a margin between the rotating shafts 36 and 56 since the coupling part 80 is supported by the upper bearing 42. This makes it possible to prevent vibrations of the rotating shafts 36 and 56 during rotation and to support the rotating shafts 36 and 56 stably.

According to the present embodiment, when the rotating shaft 36 and the rotating shaft 56 are regarded as one rotating shaft, the coupling part 80 is provided at a lower position than the vertical center point of that rotating shaft. In other words, the coupling part 80 is provided at a lower position than the vertical center point of the entirety of the two rotating shafts 36 and 56. In particular, in the present embodiment, the coupling part 80 is provided at a position approximately ⅓ from the bottom of the entirety of the two rotating shafts 36 and 56. This means that the coupling part 80 is arranged near the oil reservoir 15. As a result, the lubricating oil leaking from the coupling part 80 can be easily recovered into the oil reservoir 15 and easily supplied from the oil reservoir 15 to sliding parts again. Thus, the present embodiment makes it possible to supply lubricating oil to sliding parts stably. Moreover, the lubricating oil further can be prevented from flowing out of the closed casing 10.

Moreover, according to the present embodiment, the discharge pipe 7 for discharging the refrigerant from the internal space of the closed casing 10 is provided at a higher position than the vertical center point (than the longitudinal center point) of the closed casing 10. On the other hand, the coupling part 80 is provided at a lower position than the vertical center point of the closed casing 10. Therefore, the coupling part 80 is arranged at a location distant from the discharge pipe 7. Accordingly, the lubricating oil leaking from the coupling part 80 does not easily flow in the discharge pipe 7. Thus, the lubricating oil further can be prevented from flowing out of the closed casing 10.

According to the present embodiment, the upper bearing 42 is made of a single bearing member, and by this single bearing member, the rotating shaft 36 and the rotating shaft 56 are supported. For this reason, it is possible to reduce the parts count in comparison with the case that the bearing for covering the circumference of the coupling part 80 is divided into two bearing members, for example, a bearing member on the rotating shaft 36 side and a bearing member on the rotating shaft 56 side. It should be noted, however, that it is of course possible to form the bearing for covering the coupling part 80 is formed of a plurality of bearing members (see the second embodiment).

In the present embodiment, the circumference of the coupling part 80 is covered by the upper bearing 42, which is one of the components of the expansion mechanism 22. Therefore, it is unnecessary to provide a separate bearing independent of the compression mechanism 21 and the expansion mechanism 22, as a bearing for supporting the rotating shafts 36 and 56 and covering the circumference of the coupling part 80. As a result, it is possible to reduce the parts count.

Figure 7:
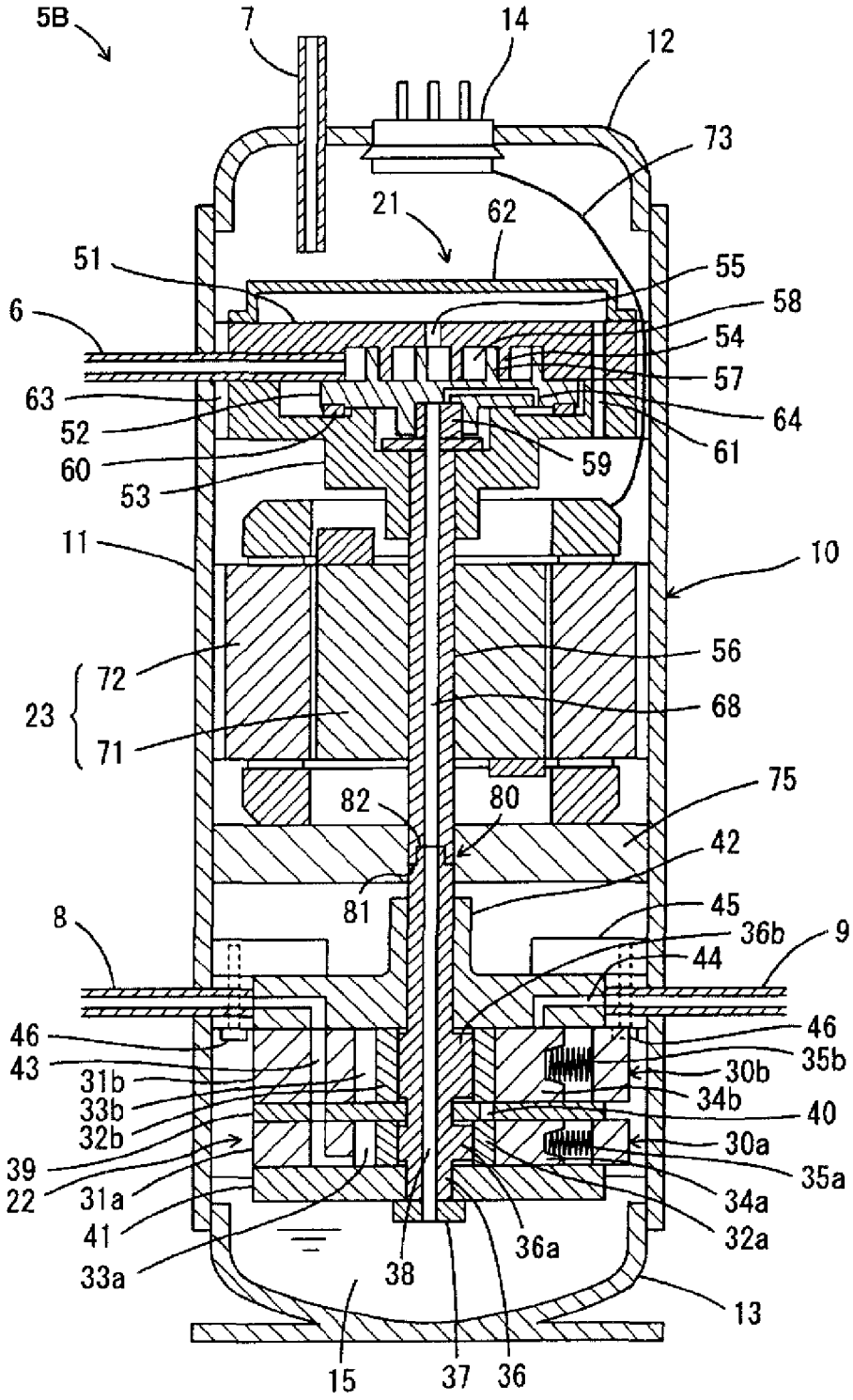
FIG. 7 is a vertical cross-sectional view of a fluid machine according to a modified example.

It should be noted, however, that the bearing for covering the circumference of the coupling part 80 may be independent of the compression mechanism 21 and the expansion mechanism 22. For example, as in a fluid machine 5B shown in FIG. 7, a bearing 75 may be provided separate from the compression mechanism 21 and the expansion mechanism 22 so that, by the bearing 75, the rotating shaft 36 and the rotating shaft 56 can be supported and the circumference of the coupling part 80 can be covered. According to such an embodiment, it becomes possible to suppress the oil leak at the coupling part 80 without changing the configurations of the compression mechanism 21 and the expansion mechanism 22.

In addition, according to the present embodiment, one of the rotating mechanisms, the compression mechanism 21, is joined to the inner wall of the closed casing 10 and the mounting member 45 is joined to the inner wall of the cylindrical body 11 of the closed casing 10, while the other one of the rotating mechanisms, the expansion mechanism 22, is fastened to the mounting member 45 by the bolts 46. Therefore, even if misalignment or assembling inaccuracy arises in the compression mechanism 21 or the expansion mechanism 22, such misalignment and inaccuracy can be absorbed when fastening the expansion mechanism 22. Thus, it is unnecessary to provide the coupling part 80 with a margin for absorbing the just-mentioned misalignment and so forth deliberately. By making the margin of the coupling part 80 smaller, the oil leak from the coupling part 80 can be reduced further. In addition, it becomes possible to couple the two rotating shafts 36 and 56 with each other more firmly. Furthermore, abrasion of the two rotating shafts 36 and 56 in the coupling part 80 can be prevented.

In addition, assembling the compression mechanism 21 and the expansion mechanism 22 to the closed casing 10 becomes easy according to the present embodiment.

According to the present embodiment, the rotating shaft 36 is provided with the shaft portion 82 while the rotating shaft 56 is provided with the boss portion 81. The coupling part 80 is configured to be an engagement structure including the shaft portion 82 and the boss portion 81. In addition, the shaft portion 82 is configured to have a spline shape, a serration shape, a polygonal shape in cross section, or the like. As a result, the rotating shaft 36 and the rotating shaft 56 can be coupled with each other more firmly. Moreover, the oil leak from the coupling part 80 can be reduced.

It should be noted that carbon dioxide is used as the refrigerant in the present embodiment. Here, carbon dioxide is a refrigerant that allows lubricating oil to dissolve therein relatively easily. For this reason, a fluid machine that uses carbon dioxide as the refrigerant tends to cause shortage of lubricating oil easily. However, the fluid machine 5A according to the present embodiment can prevent such shortage of lubricating oil effectively, as described above. Therefore, the advantageous effects of this fluid machine 5A become more significant when carbon dioxide is used as the refrigerant.

Second Embodiment

Figure 8:
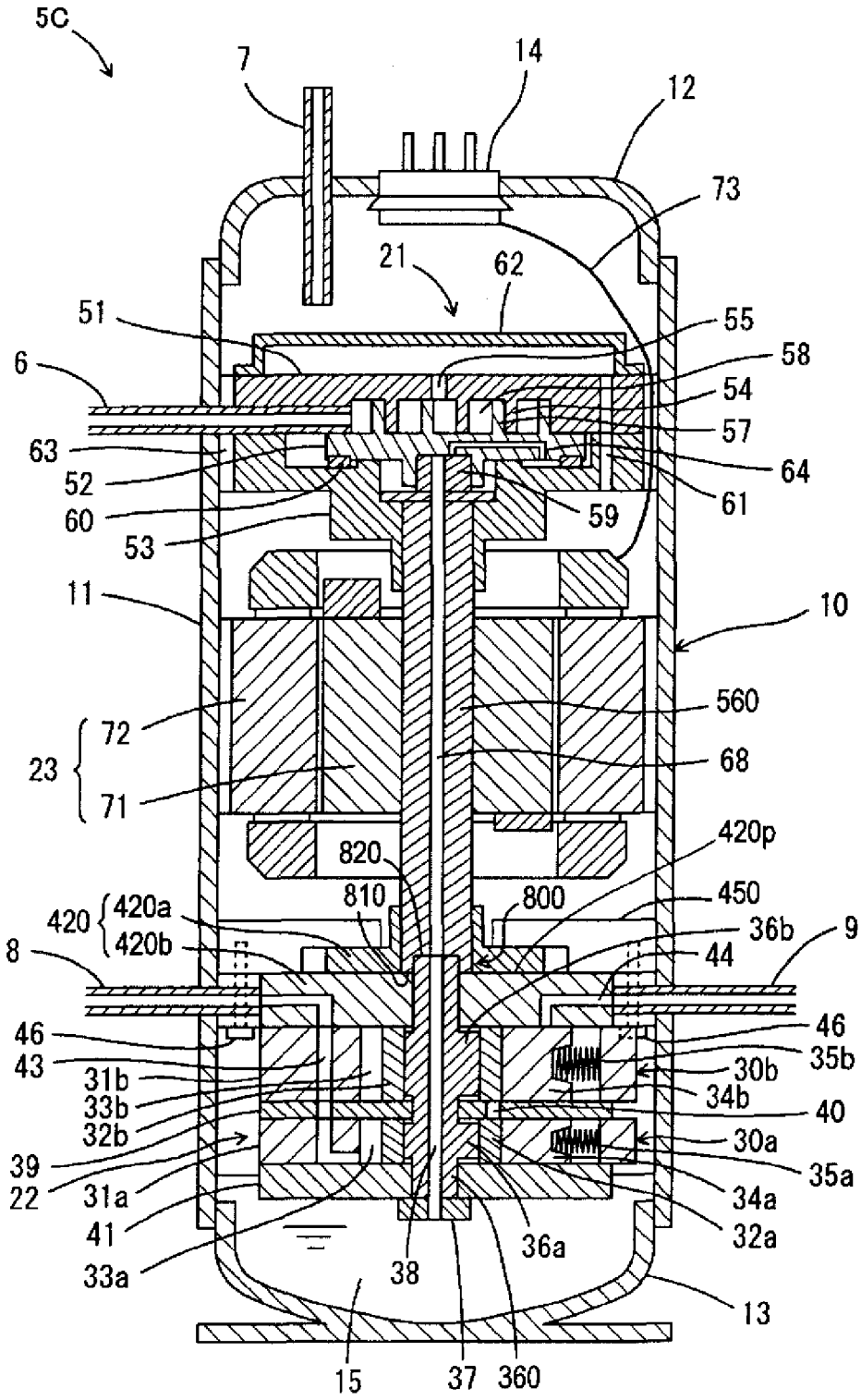
FIG. 8 is a vertical cross-sectional view of a fluid machine according to a second embodiment.

In the fluid machine 5A of FIG. 1, the upper bearing 42 is constituted by a single bearing member. In contrast, a fluid machine 5C according to a second embodiment employs an upper bearing 420, which includes two bearing members 420*a* and 420*b*, as illustrated in FIG. 8. Hereinbelow, the same parts as those in the first embodiment are designated by the same reference numerals and are therefore not further elaborated upon.

In the present embodiment, the upper bearing 420 includes the first bearing member 420*a* for supporting a rotating shaft 560 of the compression mechanism 21 and the second bearing member 420*b* for supporting a rotating shaft 360 of the expansion mechanism 22. The first bearing member 420*a* is located above the second bearing member 420*b*, and the first bearing member 420*a* and the second bearing member 420*b* are adjacent to each other along the axis direction of the rotating shafts 360 and 560 (i.e., along the vertical direction). The intake passage 43 and the discharge passage 44 are formed in the second bearing member 420*b*.

The outer circumferential surface of the rotating shaft 560 and the inner circumferential surface of the first bearing member 420*a* are opposed to each other, and a spiral shaped oil supply groove (not shown) is formed in at least one of the outer circumferential surface thereof and the inner circumferential surface thereof. Likewise, the outer circumferential surface of the rotating shaft 360 and the inner circumferential surface of the second bearing member 420*b* are opposed to each other, and a spiral shaped oil supply groove (not shown) is formed also in at least one of the outer circumferential surface thereof and the inner circumferential surface thereof.

In the present embodiment, the rotating shaft 560 and the rotating shaft 360 have different outer diameters. Specifically, the outer diameter of the rotating shaft 560 is greater than that of the rotating shaft 360. In the present embodiment, the rotating shaft 560 and the rotating shaft 360 are coupled linearly to each other at a coupling part 800 likewise. A shaft portion 810 of the other rotating shaft 360 engages with a boss portion 820 of the one rotating shaft 560 to form the coupling part 800, which is common to the previous embodiment; however, since the rotating shafts 560 and 360 have different diameters, it is unnecessary to go to the trouble of subjecting a shaft portion 810 of the other rotating shaft 360 to a diameter-reducing process.

According to the present embodiment, the circumference of the coupling part 800 of the two rotating shafts 360 and 560 is covered by the first bearing member 420*a* and the second bearing member 420*b*. This makes it possible to obtain the same advantageous effects as in first embodiment. Specifically, the oil leak from the coupling part 800 can be prevented also in the present embodiment. In addition, the lubricating oil can be prevented from flowing out of the closed casing 10. Moreover, the lubricating oil that has leaked from the coupling part 800 can serve to perform lubrication and sealing of the interiors of the first bearing member 420*a* and the second bearing member 420*b*.

Furthermore, according to the present embodiment it is unnecessary to make the outer diameters of the two rotating shafts 360 and 560 uniform. Therefore, the outer diameter of the rotating shaft 560 can be set at a value suitable for the compression mechanism 21, while the outer diameter of the rotating shaft 360 can be set at a value suitable for the expansion mechanism 22. This enables optimization of the compression mechanism 21 and the expansion mechanism 22. In addition, the constraints on the outer diameters of the rotating shaft 360 and 560 are less strict, resulting in a greater degree of freedom in designing the compression mechanism 21 and the expansion mechanism 22.

According to the present embodiment, the two rotating shafts 360 and 560 can be supported stably despite the fact that the outer diameters of the two rotating shafts 360 and 560 are different from each other, since the upper bearing 420 is divided into the first bearing member 420*a* and the second bearing member 420*b*. Specifically, bearing members that are suitable for the rotating shaft 560 and the rotating shaft 360 may be selected respectively as the first bearing member 420*a* and the second bearing member 420*b* so that the two rotating shafts 360 and 560 can be supported more stably.

The upper bearing 420 is fixed to the closed casing 10 via a mounting member 450. More specifically, the second bearing member 420*b* is attached to the mounting member 450 from below by fasteners 46 such as bolts. The first bearing member 420*a* is disposed on the second bearing member 420*b* in such a manner that it is accommodated in the space formed between the second bearing member 420*b* and the mounting member 450, and it is fixed to the mounting member 450 and/or the second bearing member 420*b* using a fastener such as a bolt, which is not shown in the drawings. The rotating shaft 560 of the compression mechanism 21 sits on a top surface 420*p* of the second bearing member 420*b*. The second bearing member 420*b* supports the thrusting force of the rotating shaft 560 by its upper face 420*p*.

It should be noted that although the outer diameter of the rotating shaft 560 of the compression mechanism 21 is described as being greater than that of the rotating shaft 360 of the expansion mechanism 22 in the present embodiment, the outer diameter of the rotating shaft of the expansion mechanism 22 may be greater than that of the rotating shaft of the compression mechanism 21. Also, it is of course possible that the two rotating shafts may have the same outer diameter.

Other Embodiments

The fluid machine according to the present invention is not limited to the foregoing first and second embodiments but may be embodied in various other embodiments.

Figure 9:
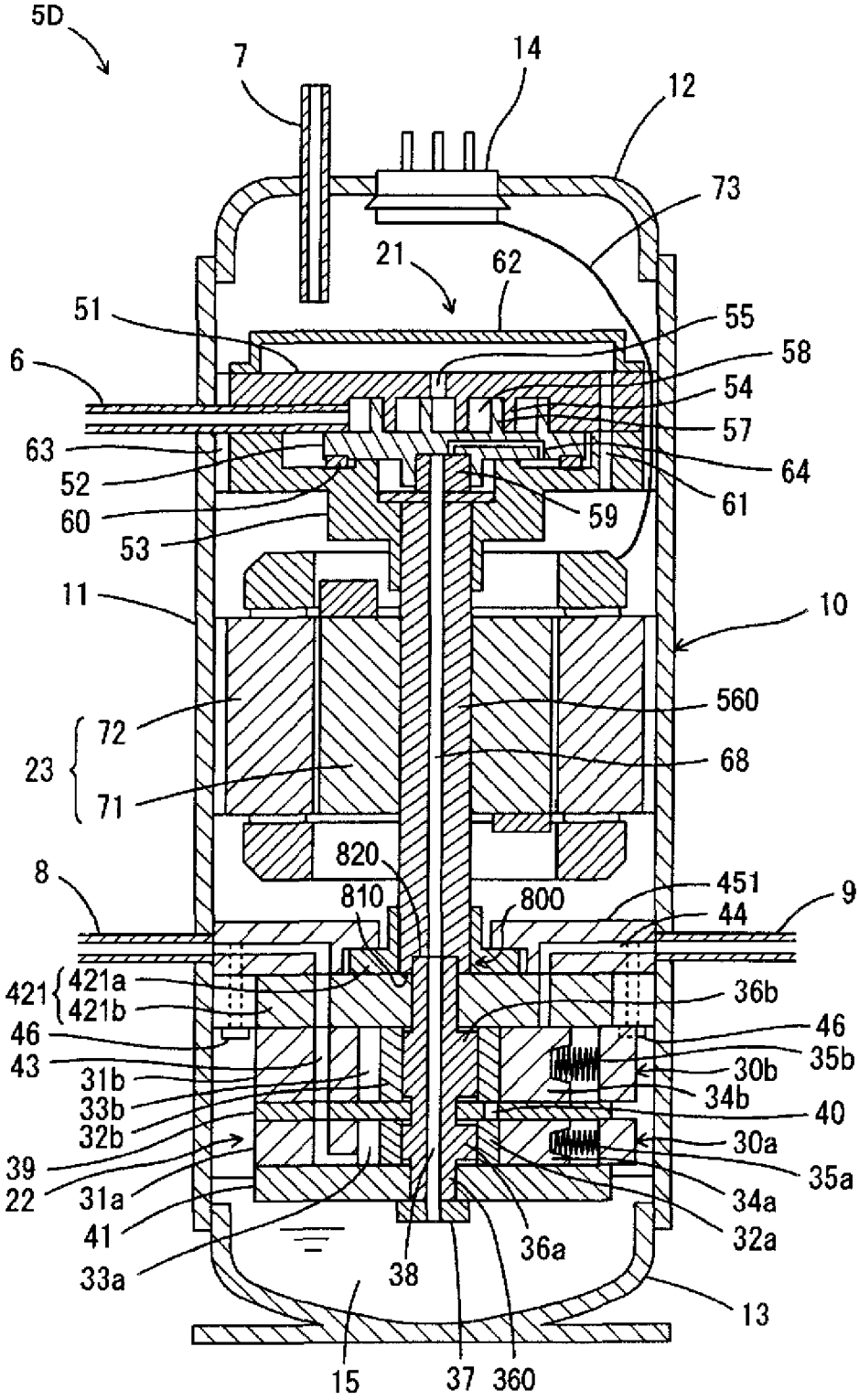
FIG. 9 is a vertical cross-sectional view of a fluid machine according to another embodiment.

For example, as in a fluid machine 5D shown in FIG. 9, it is possible to employ a mounting member 451 in which the intake passage 43 is formed therein. Specifically, the intake passage 43 for guiding refrigerant from the intake pipe 8 to the first expansion chamber 33*a* may be formed through the mounting member 451, the second bearing member 421*b* of an upper bearing 421, the cylinder 31*b* of the second expansion section 30*b*, the partition plate 39, and the cylinder 31*a* of the first expansion section 30*a*. Likewise, the discharge passage 44 may be formed in the mounting member 451. Specifically, the discharge passage 44 for guiding the refrigerant, which has expanded in the second expansion chamber 33*b*, to the discharge pipe 9 may be formed through a second bearing member 421*b* of the upper bearing 421, and the mounting member 451.

Likewise, the intake passage 43 or the discharge passage 44 may be formed through the mounting member 45 in the first embodiment.

Figure 10:
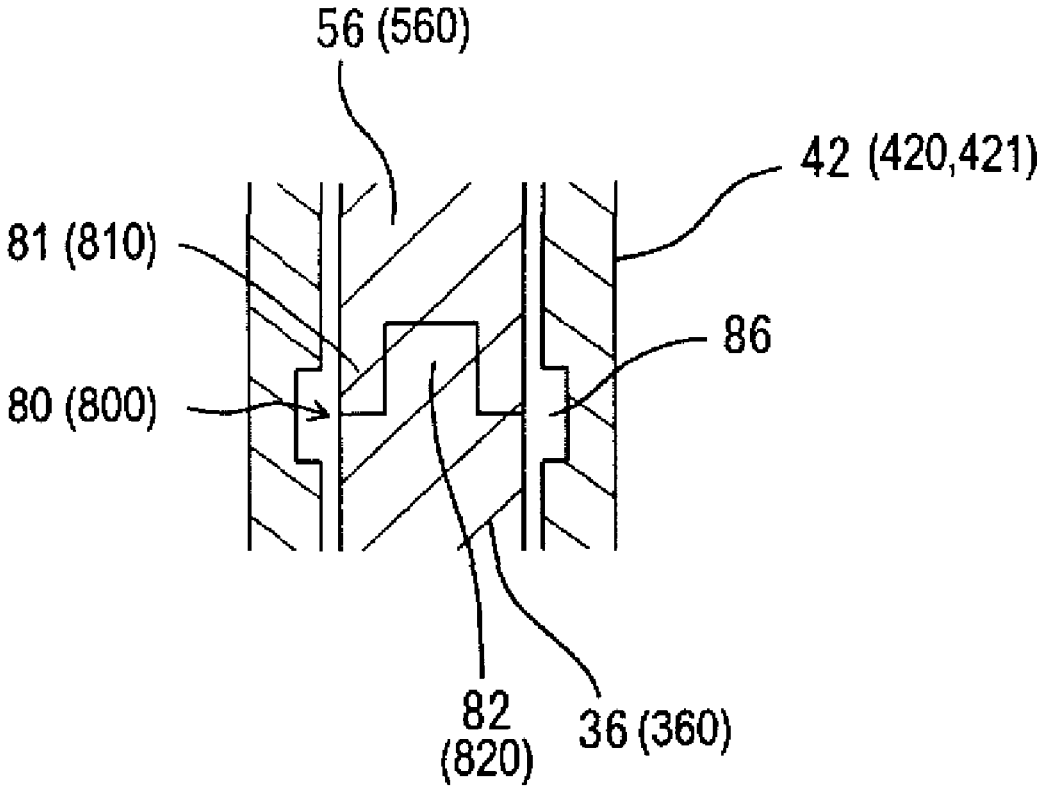
FIG. 10 is a vertical cross-sectional view of a coupling part according to another embodiment.

Further, as illustrated in FIG. 10, an oil reservoir space 86 for holding lubricating oil around the coupling part 80 (800) may be formed by forming a groove in a portion of the inner circumferential side of the upper bearing 42 (420, 421) that opposes the coupling part 80 (800). Alternatively, although not shown in the drawings, it is also possible to form a groove in the outer circumferential surface of one or both of the rotating shaft 36 (360) and the rotating shaft 56 (560) so that this groove forms the oil reservoir space. Thus, abrasion and the like of the coupling part 80 (800) is suppressed by filling a region surrounding the coupling part 80 (800) with lubricating oil, and sealing performance can be improved. As a result, reliability and the like of the fluid machine 5A can be improved.

As described above, the lubricating oil leaking out the coupling part 80 (800) of the two rotating shafts 36 and 56 (360 and 560) is utilized for lubrication and sealing between the upper bearing 42 (420 and 421) and the two rotating shafts 36 and 56 (360 and 560). Accordingly, the coupling part 80 (800) may be utilized actively as an oil supply port of lubricating oil. Since the coupling part 80 (800) is formed over the entire circumference of the rotating shafts 36 and 56 (360 and 560), it becomes possible to supply lubricating oil over the entire circumference of the rotating shafts 36 and 56 (360 and 560) uniformly by utilizing the coupling part 80 (800) as the oil supply port.

The compression mechanism 21 need not be of the scroll type but may be of other types of compression mechanisms. Likewise, the type of the expansion mechanism 22 is not limited to the rotary type. Although the expansion mechanism 22 has two cylinders (the cylinders 31*a* and 31*b*) in each of the foregoing embodiments, the number of cylinders of the expansion mechanism 22 may be one, or three or more. The compression mechanism 21 is such a type as to compress the refrigerant in multiple stages (for example, in two stages).

In the foregoing embodiments, the compression mechanism 21 is disposed above and the expansion mechanism 22 is disposed below. However, the compression mechanism 21 may be disposed below and the expansion mechanism 22 may be disposed above. In other words, it is possible for the compression mechanism 21 to be disposed below the expansion mechanism 22.

In the foregoing embodiments, the closed casing 10 is formed in a vertically oblong shape, and the compression mechanism 21 and the expansion mechanism 22 are disposed along a vertical direction. However, it is also possible to form the closed casing 10 in a horizontally oblong shape and to dispose the compression mechanism 21 and the expansion mechanism 22 along a horizontal direction. In this case, the two rotating shafts 36 and 56 (360 and 560) are coupled to each other along a horizontal direction.

In the foregoing embodiments, the compression mechanism 21 constitutes a first rotating mechanism while the expansion mechanism 22 constitutes a second rotating mechanism. However, both the first and second rotating mechanisms may be compression mechanisms, or both of them may be expansion mechanisms. In other words, although a fluid machine according to the foregoing embodiments has been described to be what is called an expander-compressor unit that includes the compression mechanism 21 and the expansion mechanism 22, a fluid machine according to the present invention may be a fluid machine including only a plurality of compression mechanisms (i.e., a compressor) or a fluid machine including only a plurality of expansion mechanisms (i.e., an expander).

In the foregoing embodiments, the number of the rotating mechanisms provided in the closed casing 10 is two (the compression mechanism 21 and the expansion mechanism 22), but it is also possible to provide three or more rotating mechanisms in the closed casing 10.

Figure 11:
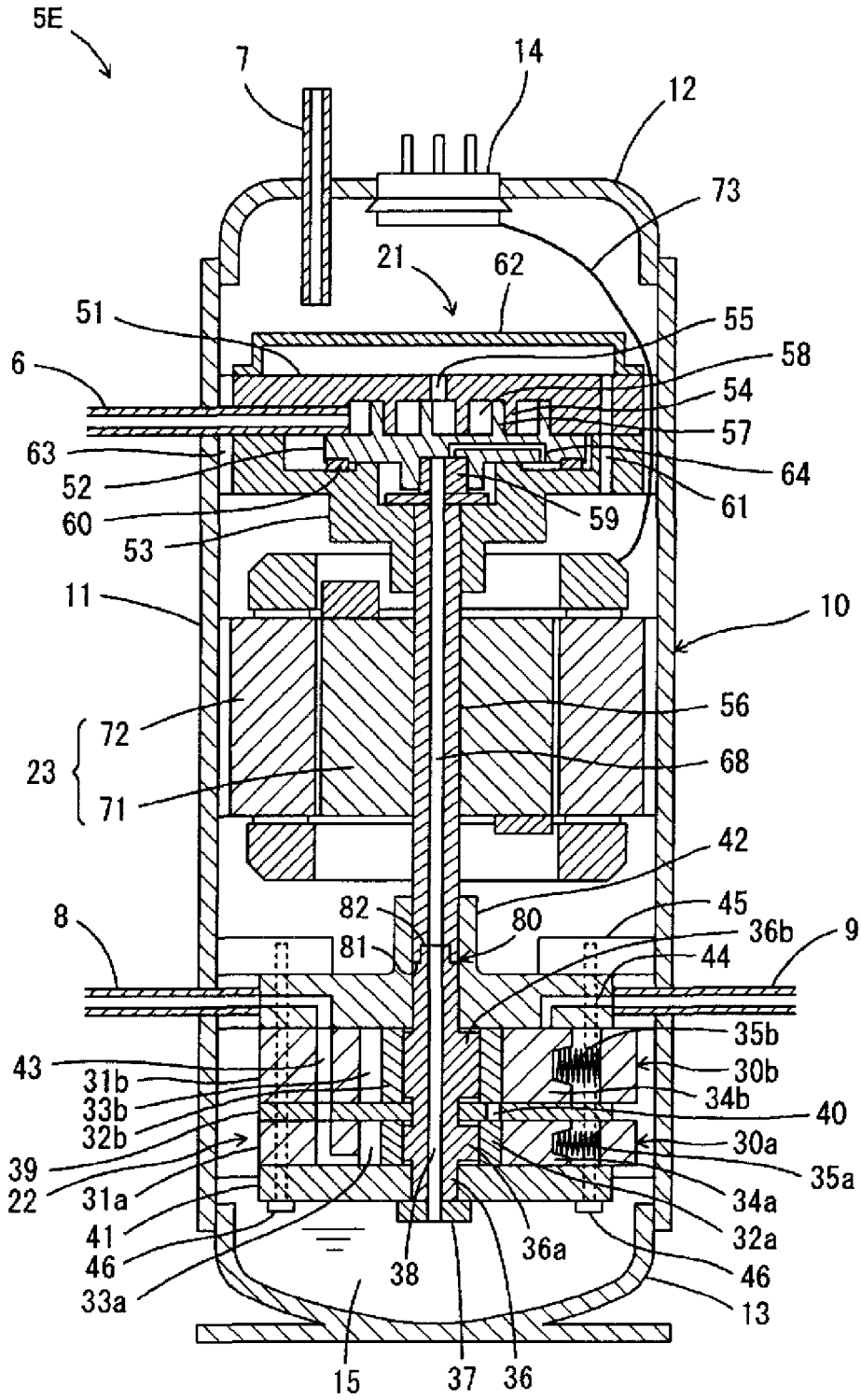
FIG. 11 is a vertical cross-sectional view of a fluid machine according to a modified example.

In the foregoing embodiments, only the upper bearing 42 in the expansion mechanism 22 is bolt fastened to the mounting member 45. However, as in a fluid machine 5E shown in FIG. 11, a plurality of components (for example, all of the upper bearing 42, the cylinder 31*b*, the partition plate 39, the cylinder 31*a*, and the lower bearing 41) in the expansion mechanism 22 may be fastened to the mounting member 45 by the bolts 46.

Figure 12:
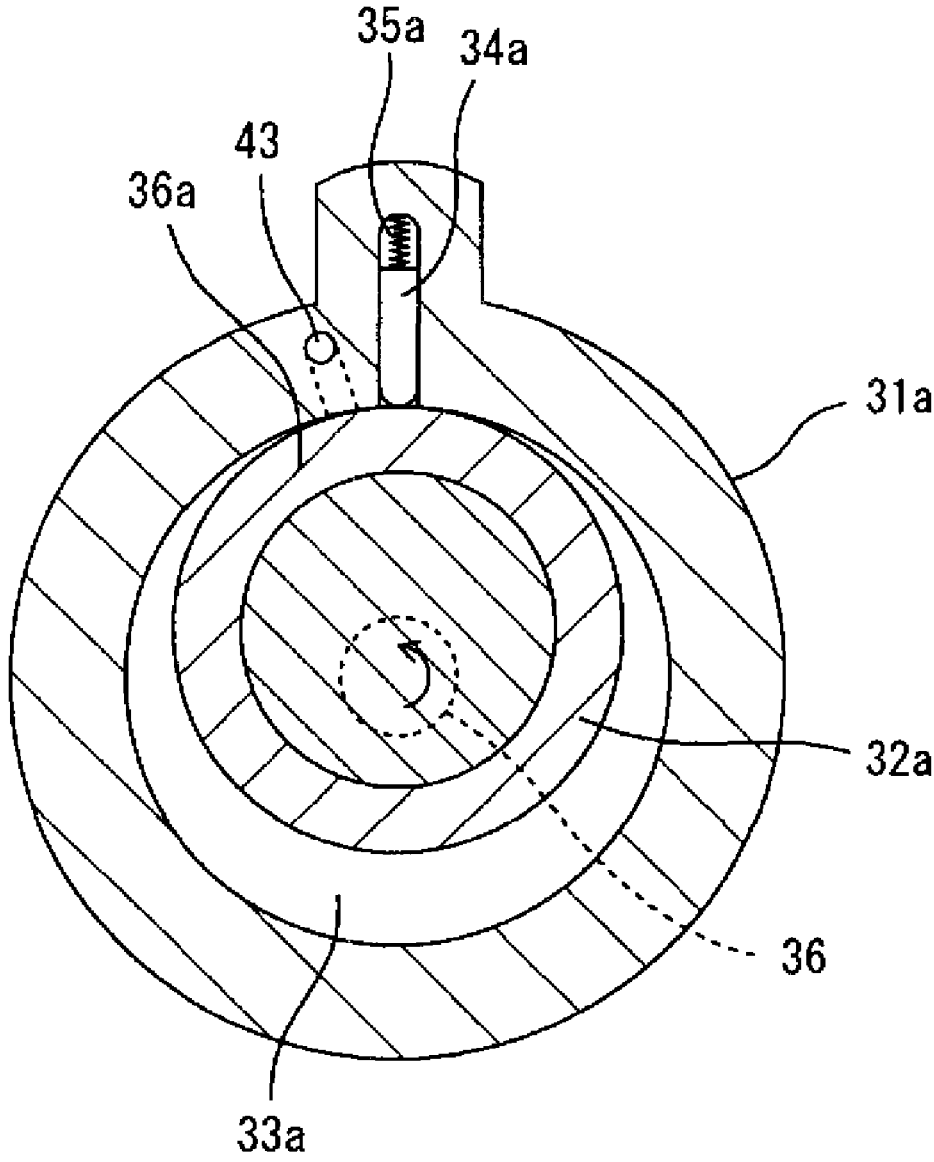
FIG. 12 is a horizontal cross-sectional view of an expansion section according to the first and second embodiments.
Figure 13:
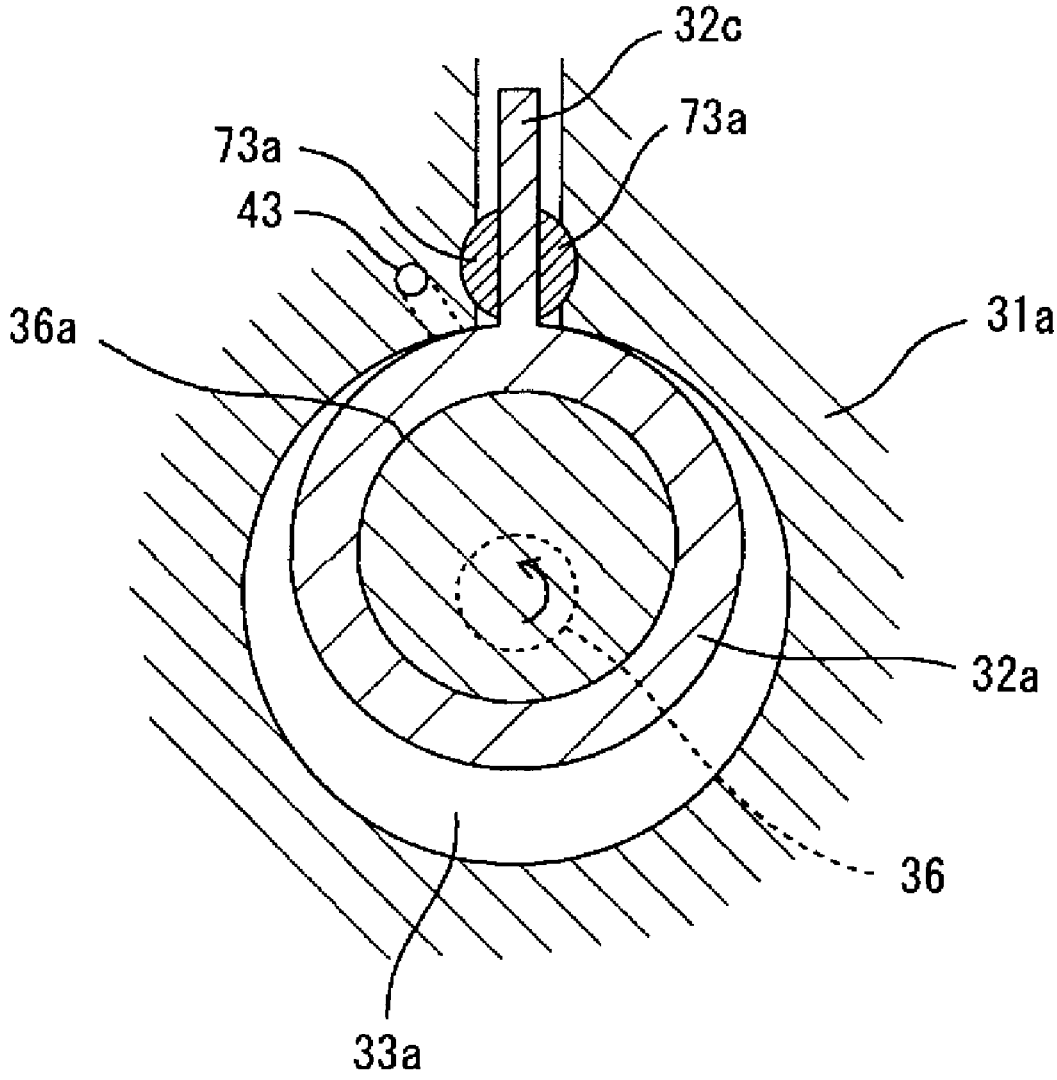
FIG. 13 is a horizontal cross-sectional view of an expansion section according to a modified example.

As illustrated in FIG. 12, in the foregoing embodiments, the first expansion section 30*a* of the expansion mechanism 22 has the cylindrically shaped piston 32*a* and the vane 34*a* that makes contact with the outer circumferential surface of the piston 32*a*. The second expansion section 30*b* is configured likewise. However, the specific configuration of the expansion mechanism is not limited to the configuration of the foregoing embodiments. The expansion sections 30*a* and 30*b* of the expansion mechanism may have what is called a swing type mechanism, for example, as illustrated in FIG. 13.

In this expansion section, a swing type piston 32*a* is provided inside the cylinder 31*a*. The eccentric portion 36*a* of the rotating shaft 36 is inserted into the piston 32*a*. A blade 32*c* is provided integrally with the piston 32*a*. The blade 32*e* protrudes outwardly from the outer circumferential surface of the piston 32*a*, and it partitions the expansion chamber 33*a* into a high-pressure side and a low-pressure side.

A pair of bushings 73*a* formed in a half-moon-like shape is provided in the cylinder 31*a*. These bushings 73*a* are disposed so as to sandwich the blade 32*c* so that the blade 32*c* slides therebetween. Also, the bushings 73*a* are configured to be rotatable with respect to the cylinder 31*a* in the state in which the blade 32*c* is sandwiched therebetween. Accordingly, the blade 32*c* that is integral with the piston 32*a* is supported onto the cylinder 31*a* via the bushings 73*a* so as to be rotatable and movable back and forth with respect to the cylinder 31*a*.

In all the embodiments described thus far, the rotating shaft 56 of the compression mechanism 21 (560) and the rotating shaft 36 of the expansion mechanism 22 (360) are coupled directly to each other. In the embodiments that will be described below, two rotating shafts are coupled to each other by a coupler. Hereinbelow, the same parts as those in the first embodiment are designated by the same reference numerals and are therefore not further elaborated upon.

Third Embodiment

Figure 14:
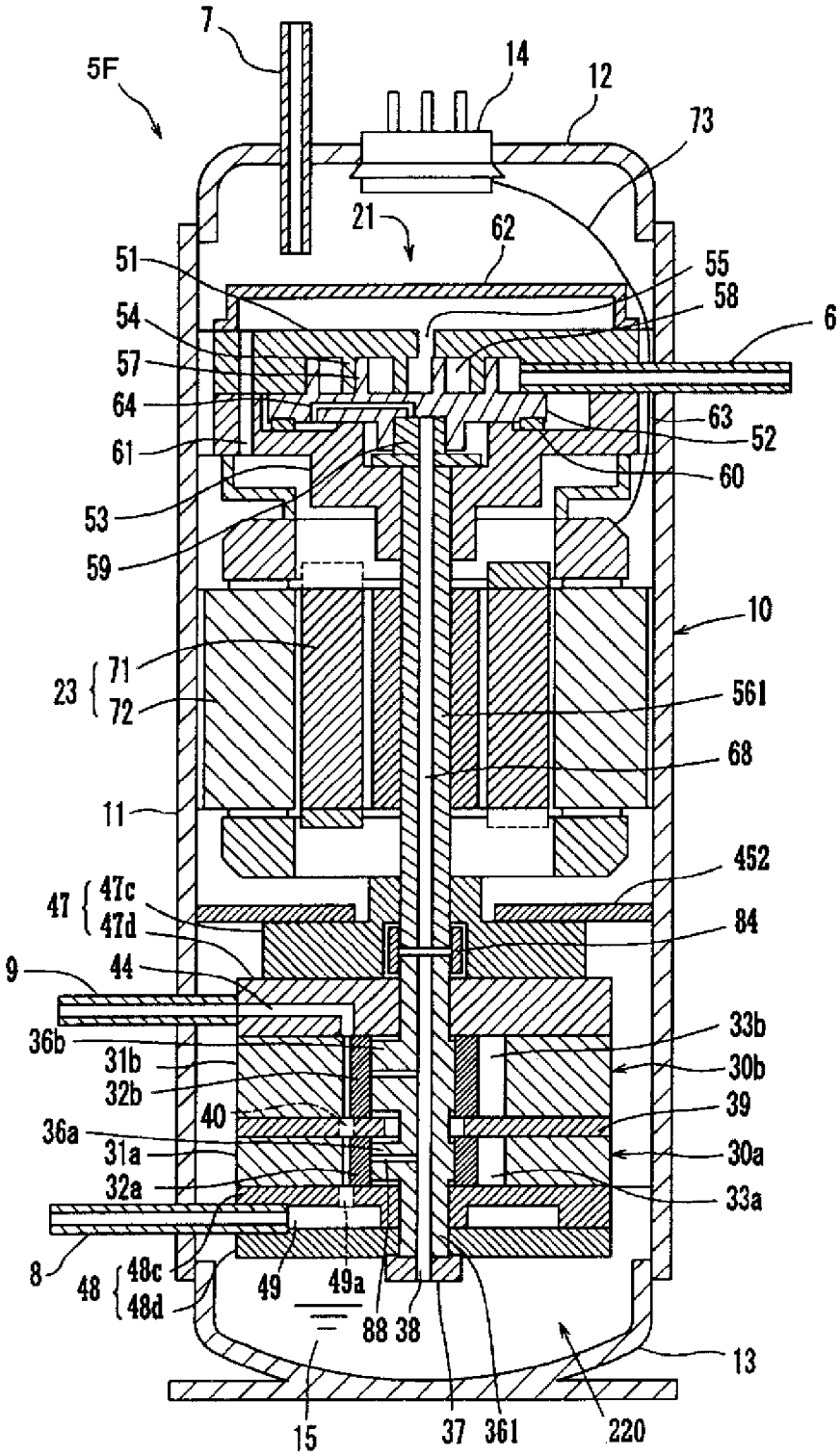
FIG. 14 is a vertical cross-sectional view of a fluid machine according to a third embodiment.

As illustrated in FIG. 14, a compression mechanism 21 and an expansion mechanism 220 of a fluid machine 5F are accommodated in the interior of a closed casing 10. The expansion mechanism 220 is disposed below the compression mechanism 21, and a motor 23 is provided between the compression mechanism 21 and the expansion mechanism 220.

The compression mechanism 21 of the fluid machine 5F is the same as the compression mechanism 21 of the fluid machine 5A shown in FIG. 1. On the other hand, changes are made in the expansion mechanism 220 from the expansion mechanism 22 of the fluid machine 5A shown in FIG. 1. The expansion mechanism 220 includes a lower bearing 48, a first expansion section 30*a*, a second expansion section 30*b*, and an upper bearing 47, in that order from axially below. There are no changes to the expansion sections 30*a* and 30*b*, but there are changes to the bearings 47 and 48 that are disposed vertically. It should be noted that the configuration of the lower bearing 48 is that of the one that has been employed conventionally. Hereinbelow, a specific description will be given mainly of the upper bearing 47.

The upper bearing 47, which closes the top of the cylinder 31*b* and the piston 32*b* of the second expansion section 30*b* and defines the second expansion chamber 33*b*, is provided above the second expansion section 30*b*. The upper bearing 47 includes a first bearing member 47*c* and a second bearing member 47*d* that are adjacent to each other along an axis direction. The first bearing member 47*c* is located above the second bearing member 47*d*.

The details will be described later, but the first bearing member 47*c* supports a rotating shaft 561 of the compression mechanism 21. On the other hand, the second bearing member 47*d* supports a rotating shaft 361 of the expansion mechanism 220.

The lower bearing 48 is provided below the first expansion section 30*a*. The lower bearing 48 includes an upper member 48*c* and a lower member 48*d* axially adjacent to each other, and the upper member 48*c* supports a lower end portion of the rotating shaft 361. The upper member 48*c* closes the bottom of the cylinder 31*a* and the piston 32*a* of the first expansion section 30*a* and defines the lower side of the first expansion chamber 33*a*. The upper member 48*c* has an annular recessed portion in its lower face, which forms an intake passage 49 between the upper member 48*c* and the lower member 48*d*. A through hole 49*a* for connecting the first expansion chamber 33*a* and the intake passage 49 is formed in the upper member 48*c*. On the other hand, the lower member 48*d* closes the bottom of the upper member 48*c* and defines the bottom of the intake passage 49.

The discharge passage 44 for guiding refrigerant from the second expansion chamber 33*b* to the discharge pipe 9 is formed in the second bearing member 47*d* of the upper bearing 47. The discharge pipe 9, piercing through the cylindrical body 11 of the closed casing 10, is connected to the second bearing member 47*d*. As mentioned above, the intake passage 49 for guiding refrigerant from the intake pipe 8 to the first expansion chamber 33*a* is formed in the lower bearing 48. The intake pipe 8, piercing through the cylindrical body 11 of the closed casing 10, is connected to the lower bearing 48.

A mounting member 452 is joined to the inner wall of the cylindrical body 11 of the closed casing 10 by welding or the like. The first bearing member 47*c* is fastened to the mounting member 452 by bolts (not shown). It should be noted that the lower member 48*d*, the upper member 48*c*, the first expansion section 30*a*, the partition plate 39, the second expansion section 30*b*, the second bearing member 47*d*, and the first bearing member 47*c* are assembled integrally in advance. As a result, by bolt fastening the first bearing member 47*c* to the mounting member 452, the entire expansion mechanism 220 is secured to the mounting member 452.

Figure 15:
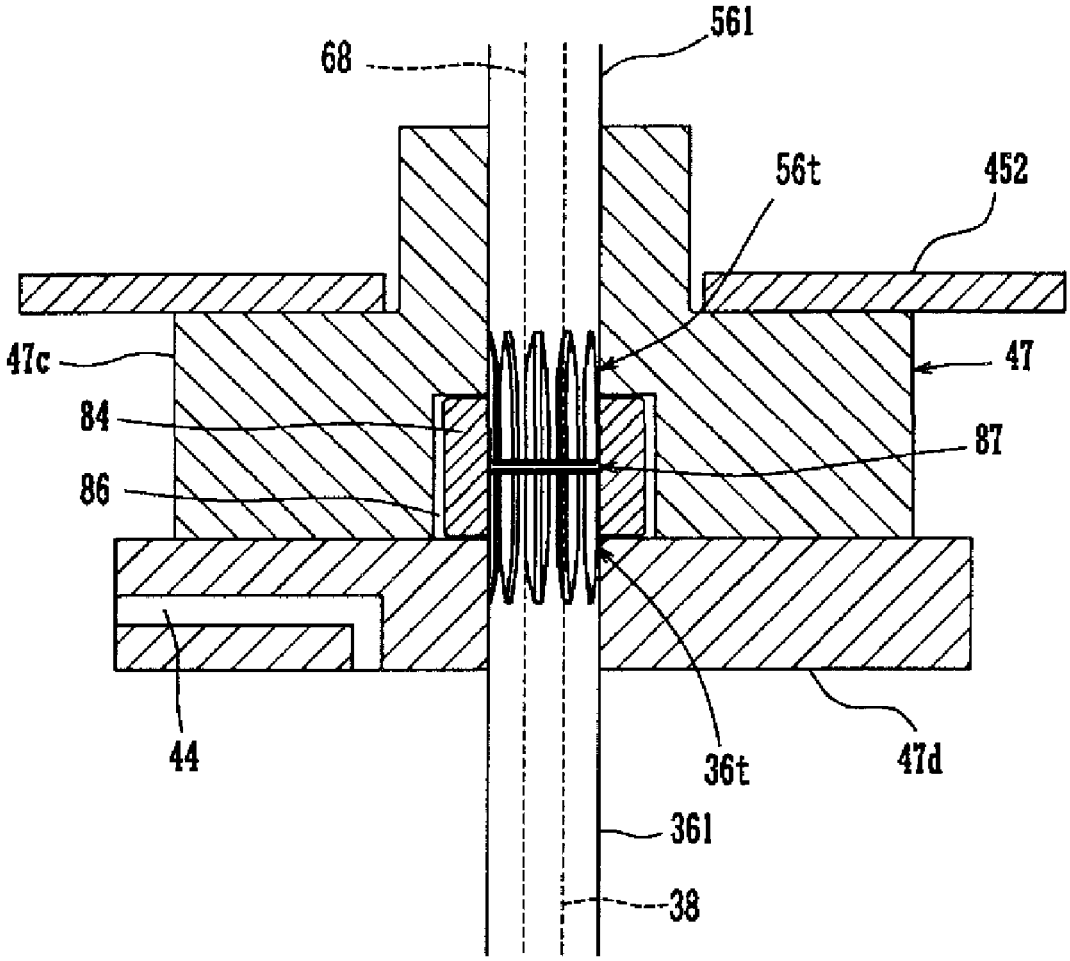
FIG. 15 is a vertical cross-sectional view of a coupling part of the rotating shafts.

As illustrated in FIG. 15 as an enlarged view, the rotating shaft 561 (hereinafter referred to as the first rotating shaft) of the compression mechanism 21 and the rotating shaft 361 (hereinafter referred to as the second rotating shaft) of the expansion mechanism 220 are coupled linearly to each other at a coupling part 87. Specifically, the first rotating shaft 561 and the second rotating shaft 361 are coupled to each other by a coupling member 84. The coupling member 84 is accommodated in a recessed portion 86 formed at a face of the first bearing member 47*c*, the face opposing the second bearing member 47*d*.

Figure 16A:
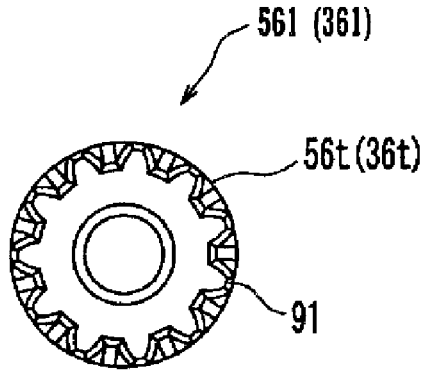
FIG. 16A is a plan view of the rotating shaft.
Figure 16B:
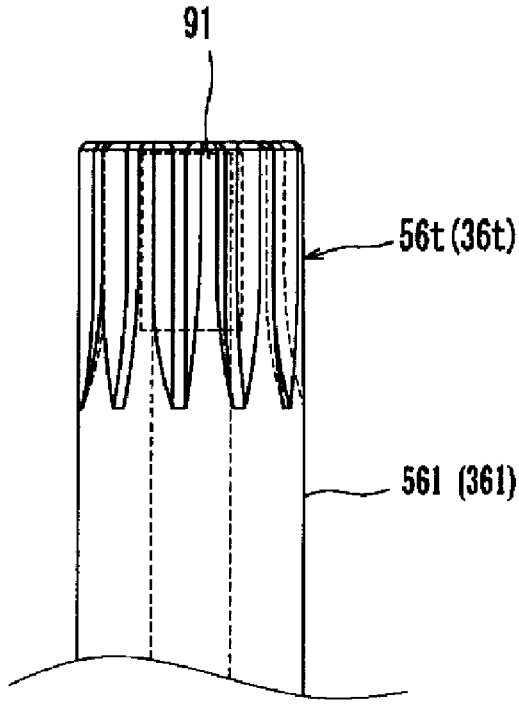
FIG. 16B is a side view of the rotating shaft.

As illustrated in FIGS. 16A and 16B, an end portion of the first rotating shaft 561 that is on the coupling part 87 side forms a coupling end portion 56*t* having what is called a spline shape, in which a plurality of grooves 91 are formed in its outer circumferential surface. Likewise, an end of the second rotating shaft 361 on the coupling part 87 side forms a coupling end portion 36*t* having what is called a spline shape, in which a plurality of grooves 91 are formed in its outer circumferential surface.

Figure 17A:
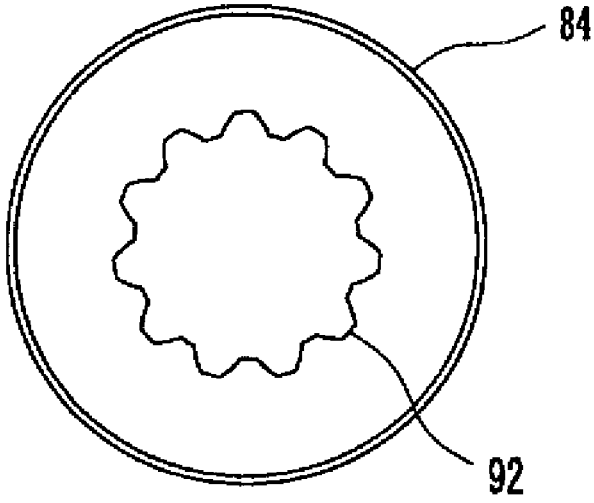
FIG. 17A is a plan view of a coupling member.
Figure 17B:
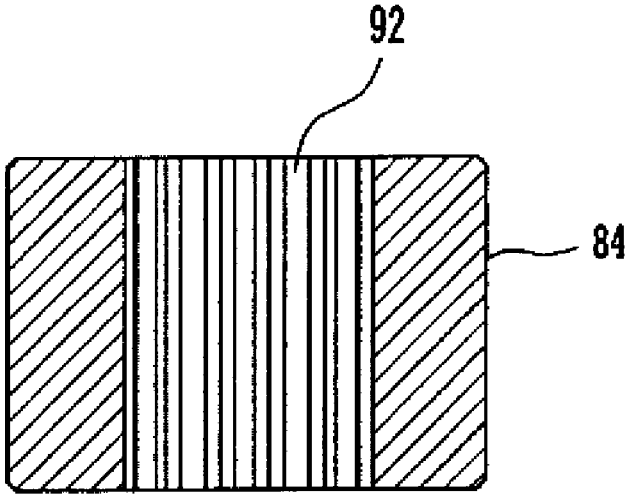
FIG. 17B is a vertical cross-sectional view of the coupling member.

As illustrated in FIGS. 17A and 17B, the coupling member 84 is formed in a ring shape. A plurality of grooves 92 corresponding to the spline shape formed in the outer circumferential surfaces of the coupling end portion 56*t* and the coupling end portion 36*t* (see FIGS. 16A and 16B) are formed in the inner circumferential surface of the coupling member 84. Although the material for the coupling member 84 is not particularly limited, the coupling member 84 is formed of a bearing steel softer than the rotating shafts 361 and 561 in the present embodiment. The method for fabricating the coupling member 84 is not limited in any way either, but in the present embodiment, the coupling member 84 is fabricated by a punch-out process.

As illustrated in FIG. 15, the oil supply passage 38 of the second rotating shaft 361 and the oil supply passage 68 of the first rotating shaft 561 are connected to each other at the coupling part 87. The coupling member 84 couples the coupling end portion 56*t* of the first rotating shaft 561 and the coupling end portion 36*t* of the second rotating shaft 361 to each other by being spline fitted thereto. As a result, the coupling end portion 56*t* of the first rotating shaft 561 and the coupling end portion 36*t* of the second rotating shaft 361 are covered integrally by the coupling member 84. Thus, the circumference of the coupling part 87 is covered by the coupling member 84.

As already described above, the coupling member 84 is accommodated in the recessed portion 86 of the first bearing member 47*c*. Thus, the circumference of the coupling member 84 is covered by the first bearing member 47*c*. It should be noted that in the present embodiment, the inner diameter of the oil supply passage 38 and that of the oil supply passage 68 are designed to be equal to each other.

The operation of the fluid machine 5F is the same as described in the first embodiment. The lubricating oil in the oil reservoir 15 is supplied to the expansion mechanism 220 and the compression mechanism 21 in association with the operation of the fluid machine 5F and performs lubrication and sealing for various sliding parts.

Here, because the first rotating shaft 561 and the second rotating shaft 361 are separate members from each other, there is a slight gap in the coupling part 87 of the first rotating shaft 561 and the second rotating shaft 361. However, the oil leak from the coupling part 87 is suppressed because the circumference of the coupling part 87 is covered by the coupling member 84.

Next, a method of assembling the fluid machine 5F will be described below.

In assembling the fluid machine 5F, first, the cylindrical body 11 of the closed casing 10 is prepared, and the stator 72 of the motor 23 and the mounting member 452 are joined to the inner wall of the cylindrical body 11. Next, the compression mechanism 21 in which the rotor 71 is fixed to the first rotating shaft 561 is inserted from one end (the upper end of FIG. 14) of the cylindrical body 11 and the compression mechanism 21 is joined to the inner wall of the cylindrical body 11. Next, the first bearing member 47*c* is attached to the mounting member 452 and subjected to alignment with the first rotating shaft 561, and thereafter, the first bearing member 47*c* is fastened to the mounting member 452 by bolts, which are not shown in the drawings. Next, the expansion mechanism 220 is inserted from the other end (the lower end in FIG. 14) of the cylindrical body 11, and then, the second rotating shaft 361 is fitted to the coupling member 84, which has been fitted to the outer side of the coupling end portion 56*t* of the first rotating shaft 561 in advance, from the opposite side to the first rotating shaft 561, to couple the first rotating shaft 561 and the second rotating shaft 361 to each other. Thereafter, the expansion mechanism 220 is fastened to the mounting member 452 by bolts, which are not shown in the drawings.

The other respects are the same as described in the first embodiment.

As has been described above, according to the present embodiment, the rotating shaft 561 of the compression mechanism 21 and the rotating shaft 361 of the expansion mechanism 220 are separate components from each other, and the rotating shafts 361 and 561 are coupled to each other via the coupling member 84. Therefore, assembling of the compression mechanism 21 and the expansion mechanism 220 to the closed casing 10 becomes easy.

Moreover, according to the present embodiment, the coupling member 84 is disposed inside the upper bearing 47 and is covered by the upper bearing 47. Therefore, the lubricating oil does not leak from the coupling part 87 (the gap between the rotating shaft 361 and the rotating shaft 561) easily. Accordingly, the lubricating oil also can be supplied stably to the compression mechanism 21, which is the rotating mechanism located above.

Moreover, according to the present embodiment, since the oil leak from the coupling part 87 can be prevented, it is possible to prevent the lubricating oil from flowing out of the closed casing 10 from the discharge pipe 7 together with the refrigerant. Thus, shortage of lubricating oil in the closed casing 10 can be prevented.

In this fluid machine 5F, a gap with a predetermined width is provided between the first rotating shaft 561 and the second rotating shaft 361 in order to absorb positioning misalignment during fabrication, thermal deformation or the like. For this reason, it is expected that lubricating oil leaks from this gap. Nevertheless, the leaked lubricating oil is supplied to the parts that intrinsically require the lubricating oil, in other words, between the first bearing member 47*c* and the first rotating shaft 561 or between the second bearing member 47*d* and the second rotating shaft 361, and therefore is utilized effectively for lubricating the sliding parts. As a result, according to the present embodiment, it is unnecessary to provide a sealing member such as an O-ring to prevent the oil leak. Accordingly, the present embodiment makes it possible to reduce the parts count. Moreover, the problem of deterioration in the sealing member can be avoided.

In the present embodiment, a gap with a predetermined width is provided between the outer circumferential surface of the coupling member 84 and the inner circumferential surface of the first bearing member 47*c* (see FIG. 15), and the coupling member 84 itself is not supported by the first bearing member 47*c*. However, it is also possible to support the coupling member 84 by the first bearing member 47*c*. In this case, the first rotating shaft 561 and the second rotating shaft 361 are, what is called, spline-fitted to the coupling member 84. The coupling member 84 is supported rotatably by the first bearing member 47*c*. As a result, the coupling end portions 36*t* and 56*t* of the two rotating shafts 361 and 561 are supported by the first bearing member 47*c* via the coupling member 84. This makes it possible to reduce wobbling of the rotating shafts 361 and 561 during rotation and to support the rotating shafts 361 and 561 stably.

In the present embodiment, each of the first rotating shaft 561 and the second rotating shaft 361 is fitted to the coupling member 84 in a non-press-fit condition. For this reason, the first rotating shaft 561 and the second rotating shaft 361 can be fitted to the coupling member 84 easily, so assemblability can be improved.

However, it is also possible that one of the first rotating shaft 561 and the second rotating shaft 361 be press-fitted to the coupling member 84. For example, it is possible that the first rotating shaft 561 may be press-fitted to the coupling member 84 while the second rotating shaft 361 may be fitted to the coupling member 84 in a non-press-fit condition. In this case, the lubricating oil does not leak from the gap between the first rotating shaft 561 and the coupling member 84 easily. Accordingly, much of the lubricating oil that has flowed through the oil supply passage 38 of the second rotating shaft 361 is allowed to flow through the oil supply passage 68 of the first rotating shaft 561 and is supplied to the compression mechanism 21. Meanwhile, assembling of the second rotating shaft 361 and the coupling member 84 is easy since the second rotating shaft 361 and the coupling member 84 are fitted to each other in a non-press-fit condition, so the assemblability is not spoiled.

Figure 18:
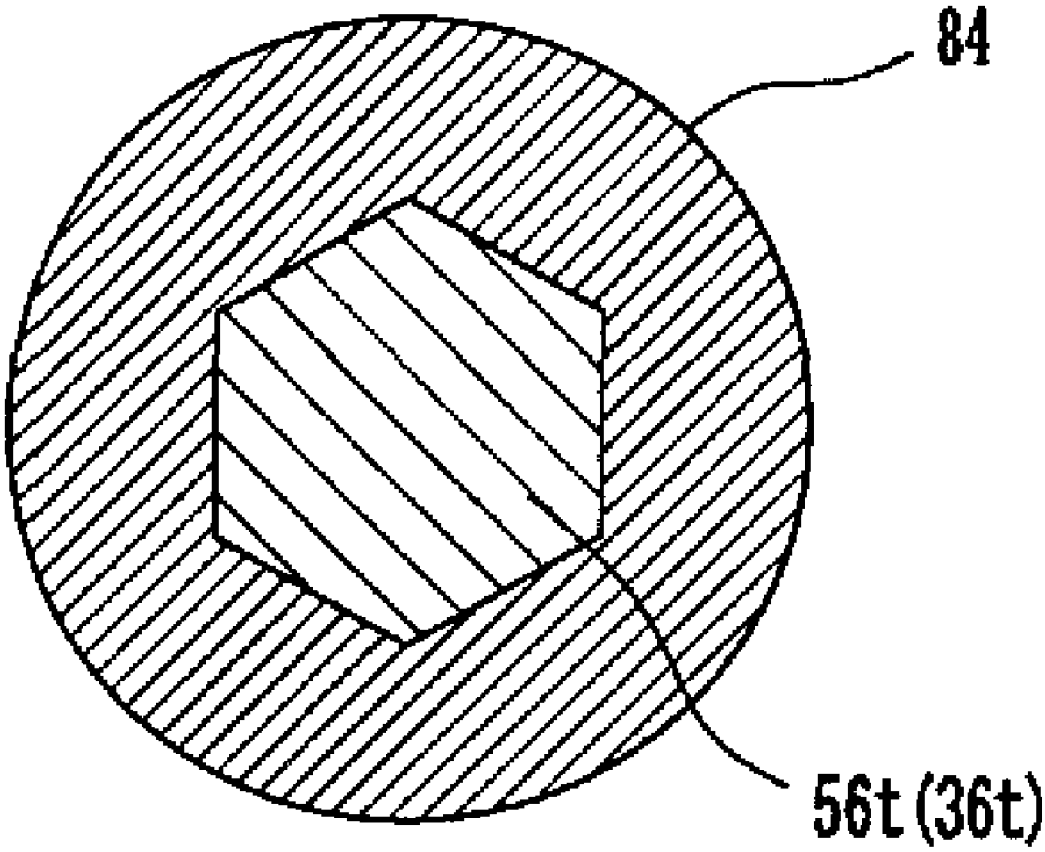
FIG. 18 is cross-sectional view of a coupling member and a rotating shaft of a fluid machine according to a modified example.

It should be noted that the engagement shape of the first rotating shaft 561 and the second rotating shaft 361 with the coupling member 84 is not limited to the spline shape as in the present embodiment. For example, as illustrated in FIG. 18, the outer circumferential contours in cross section of the coupling end portion 56*t* and the coupling end portion 36*t* may be formed into a hexagonal shape, and the inner circumferential contour in cross section of the coupling member 84 may be formed into a hexagonal shape corresponding to the coupling end portion 56*t* and the coupling end portion 36*t*. Alternatively, the outer circumferential contours in cross section of the coupling end portion 56*t* and the coupling end portion 36*t* may be formed into a polygonal shape other than the hexagonal shape, and the inner circumferential contour in cross section of the coupling member 84 may be formed into a polygonal shape corresponding to the coupling end portion 56*t* and the coupling end portion 36*t*.

With the fluid machine 5F according to the present embodiment, it is not necessary to make the outer diameters of both the coupling end portions 36*t* and 56*t* of the two rotating shafts 361 and 561 smaller in comparison with the cases that the two rotating shafts 361 and 561 are fitted directly to each other. This enables what is called a torque transmission radius to be large, improving the reliability of the coupling part 87.

Moreover, the processing becomes easier since it is unnecessary to form protrusions or recesses in the two rotating shafts 361 and 561 for engagement. Furthermore, productivity can be enhanced since the coupling member 84 can be formed easily by a punch-out process or the like.

The upper bearing 47 of the present embodiment includes separate bearing members, i.e., the first bearing member 47*c* for supporting the first rotating shaft 561 and the second bearing member 47*d* for supporting the second rotating shaft 361. Accordingly, the rotating shafts can be supported stably and the oil leak can be reduced by, for example, combining bearing members that are suitable for supporting the rotating shafts respectively.

The coupling member 84 of the present embodiment is accommodated in the recessed portion 86 formed at the face of the first bearing member 47*c*, the face opposing the second bearing member 47*d*. Thereby, the coupling member 84 can be placed between the first bearing member 47*c* and the second bearing member 47*d* by coupling the first bearing member 47*c* and the second bearing member 47*d* to each other after inserting the coupling member 84 into the recessed portion 86. For that reason, the coupling member 84 can be disposed inside the upper bearing 47 with a simple configuration. It should be noted that the recessed portion 86 for accommodating the coupling member 84 therein may be formed at a face of the second bearing member 47*d*, the face opposing the first bearing member 47*c*.

In addition, according to the present embodiment, when the first rotating shaft 561 and the second rotating shaft 361 are regarded as one rotating shaft, the coupling member 84 is provided at a lower position than the vertical center point of that rotating shaft. In other words, the coupling member 84 is provided at a lower position than the vertical center point of the entirety of the two rotating shafts 361 and 561. In particular, in the present embodiment, the coupling member 84 is provided at a position approximately ⅓ from the bottom of the entirety of the two rotating shafts 361 and 561. This means that the coupling member 84 is arranged near the oil reservoir 15. As a result, the lubricating oil leaking from the coupling member 84 can be easily returned into the oil reservoir 15 and supplied easily from the oil reservoir 15 to sliding parts again. Thus, the present embodiment makes it possible to supply lubricating oil to sliding parts stably. Moreover, the lubricating oil further can be prevented from flowing out of the closed casing 10.

Moreover, according to the present embodiment, the discharge pipe 7 for discharging the refrigerant from the internal space of the closed casing 10 is provided at a higher position than the vertical center point (than the longitudinal center point) of the closed casing 10. On the other hand, the coupling member 84 is provided at a lower position than the vertical center point of the closed casing 10. Therefore, the coupling member 84 is arranged at a location distant from the discharge pipe 7. Accordingly, the lubricating oil leaking from the coupling member 84 does not easily flow in the discharge pipe 7. Thus, the lubricating oil further can be prevented from flowing out of the closed casing 10.

In the present embodiment, the circumference of the coupling part 87 is covered by the coupling member 84, and the circumference of the coupling member 84 is covered by the upper bearing 47, which is one of the components of the expansion mechanism 220. Therefore, it is unnecessary to provide a separate bearing independent of the compression mechanism 220, as a bearing for supporting the rotating shafts 361 and 561 and covering the circumference of the coupling member 84. As a result, it is possible to reduce the parts count.

Figure 19:
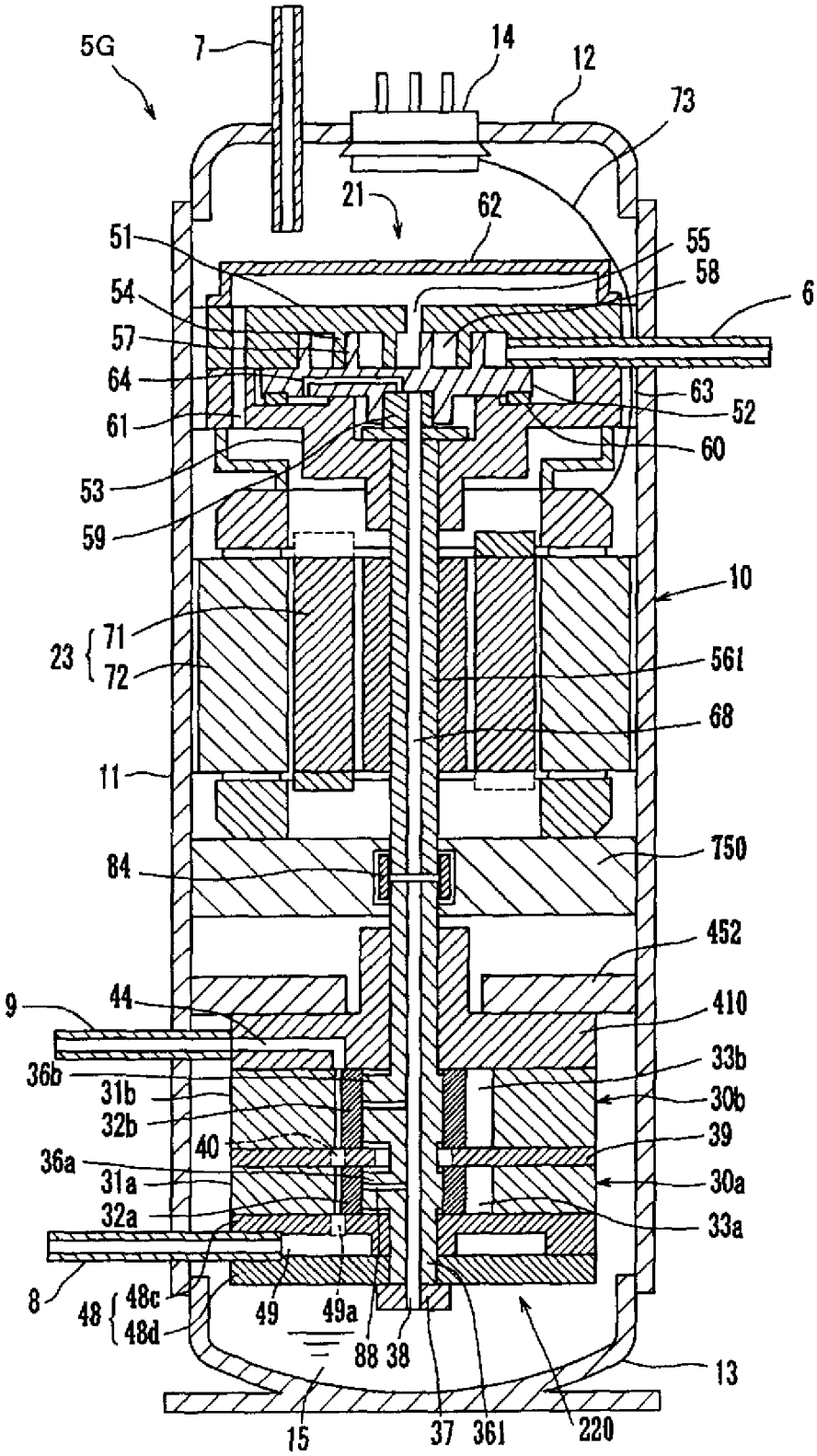
FIG. 19 is a vertical cross-sectional view of a fluid machine according to a modified example.

It should be noted, however, that the bearing for covering the circumference of the coupling member 84 may be independent of the compression mechanism 21 and the expansion mechanism 220. For example, as shown in a fluid machine 5G of FIG. 19, a bearing 750 may be provided separate from the compression mechanism 21 and the expansion mechanism 220 so that, by this bearing 750, the second rotating shaft 361 and the first rotating shaft 561 can be supported and the circumference of the coupling member 84 can be covered. An upper bearing 410 of the expansion mechanism 220 is provided separately from the bearing 750 for covering the coupling member 84. According to such an embodiment, it becomes possible to suppress the oil leak at the coupling part 87 of the two rotating shafts 361 and 561 without changing the configurations of the compression mechanism 21 and the expansion mechanism 220.

Figure 20:
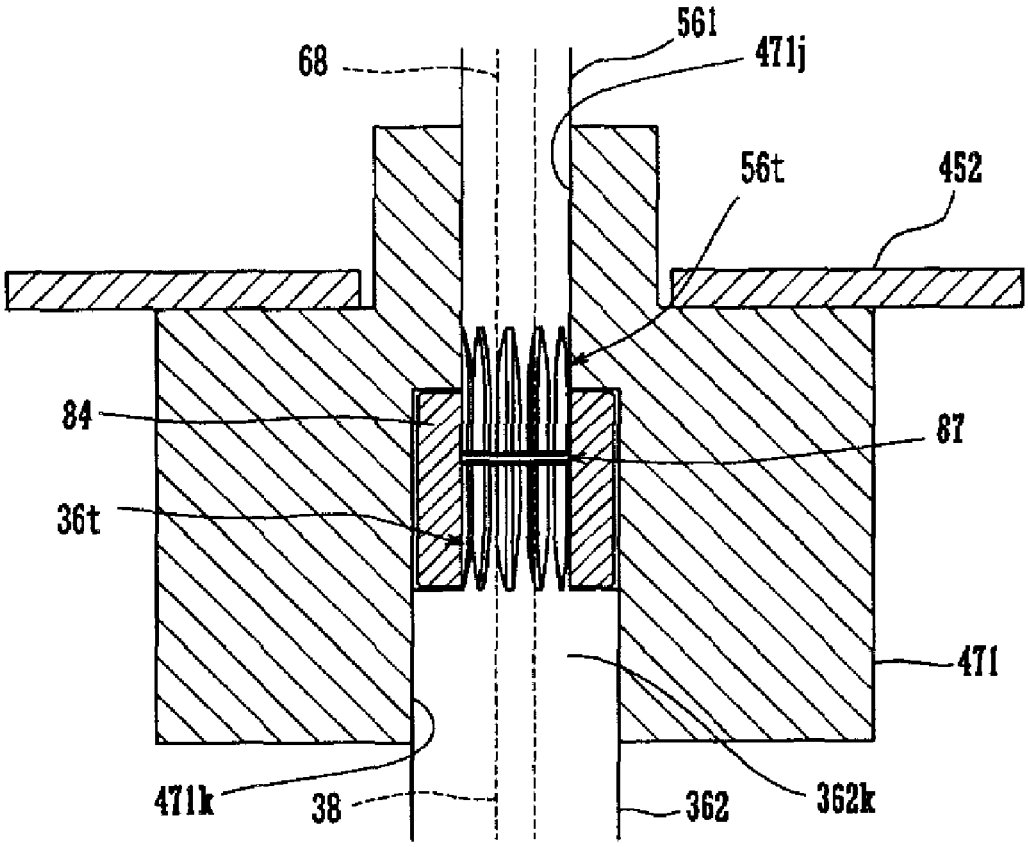
FIG. 20 is a vertical cross-sectional view of a coupling part of rotating shafts in a fluid machine according to a modified example.

In addition, the embodiment of FIG. 14, the upper bearing 47 includes the first bearing member 47*c* for supporting the first rotating shaft 561 and covering the circumference of the coupling member 84 and the second bearing member 47*d* for supporting the second rotating shaft 361. However, the configuration of the upper bearing that accommodates the coupling member 84 is not limited to this configuration. For example, an upper bearing 471 shown in FIG. 20 is made of one bearing member, and supports both the first rotating shaft 561 and the second rotating shaft 361. According to such an embodiment, the parts count can be reduced because the upper bearing 471 is made of a single member. In such an embodiment as well, the oil leak from the coupling part 80 can be reduced.

In the example of FIG. 20, the first rotating shaft 561 and the second rotating shaft 362 having different outer diameters are coupled to each other by the coupling member 84. By doing so, it is unnecessary to make the outer diameters of the two rotating shafts 561 and 362 uniform. Therefore, the outer diameter of the rotating shaft 561 can be set at a value suitable for the compression mechanism 21, while the outer diameter of the rotating shaft 362 can be set at a value suitable for the expansion mechanism 220. In addition, the constraints on the outer diameters of the rotating shaft 362 and 561 are less strict, resulting in a greater degree of freedom in designing the compression mechanism 21 and the expansion mechanism 220.

The problem of how the rotating shafts should be coupled to each other using the coupling member 84 arises in the case of the rotating shafts 362 and 561 having different outer diameters; however, this problem can be resolved by the example shown in FIG. 20.

As illustrated in FIG. 20, a first inserting hole 471*j* having a smaller inner diameter and a second inserting hole 471*k* being communicated and aligned axially with the first inserting hole 471*j* and having a larger inner diameter than the first inserting hole 471*j* are formed in the upper bearing 471 including a single bearing member. The coupling member 84 is disposed within the second inserting hole 471*k*. One end of the first rotating shaft 561, i.e., the coupling end portion 56*t* that is groove-processed, pierces through the first inserting hole 471*j* formed in the upper bearing 471 and is engaged with the coupling member 84. The coupling end portion 36*t* that is to be engaged with the coupling member 84 is formed in the second rotating shaft 362 by diameter-reducing processing and grooving processing. More specifically, a larger-diameter portion 362*k*, as a supported portion, that is inserted in the second inserting hole 471*k* of the upper bearing 471 and is supported radially is formed at one end of the second rotating shaft 362, and a coupling end portion 36*t*, as a leading end portion, that has a smaller outer diameter than the supported portion 362*k* and is to be engaged with the coupling member 84, is formed also at one end of the second rotating shaft 362.

In the above-described way, the two rotating shafts 561 and 362 can be coupled to each other easily by a simple work such that, after fitting the coupling member 84 into the second inserting hole 471*k* of the upper bearing 471, the first rotating shaft 561 is inserted into the first inserting hole 471*j* and brought into engagement with the coupling member 84 and the second rotating shaft 362 is inserted into the second inserting hole 471*k* to bring it in engagement with the coupling member 84. It should be noted that the size relationship of the outer diameters of the rotating shafts may be opposite to each other. In that case, the size relationship between the inner diameters of the inserting holes in the upper bearing 471 becomes opposite to that in the example shown in FIG. 20.

Figure 21:
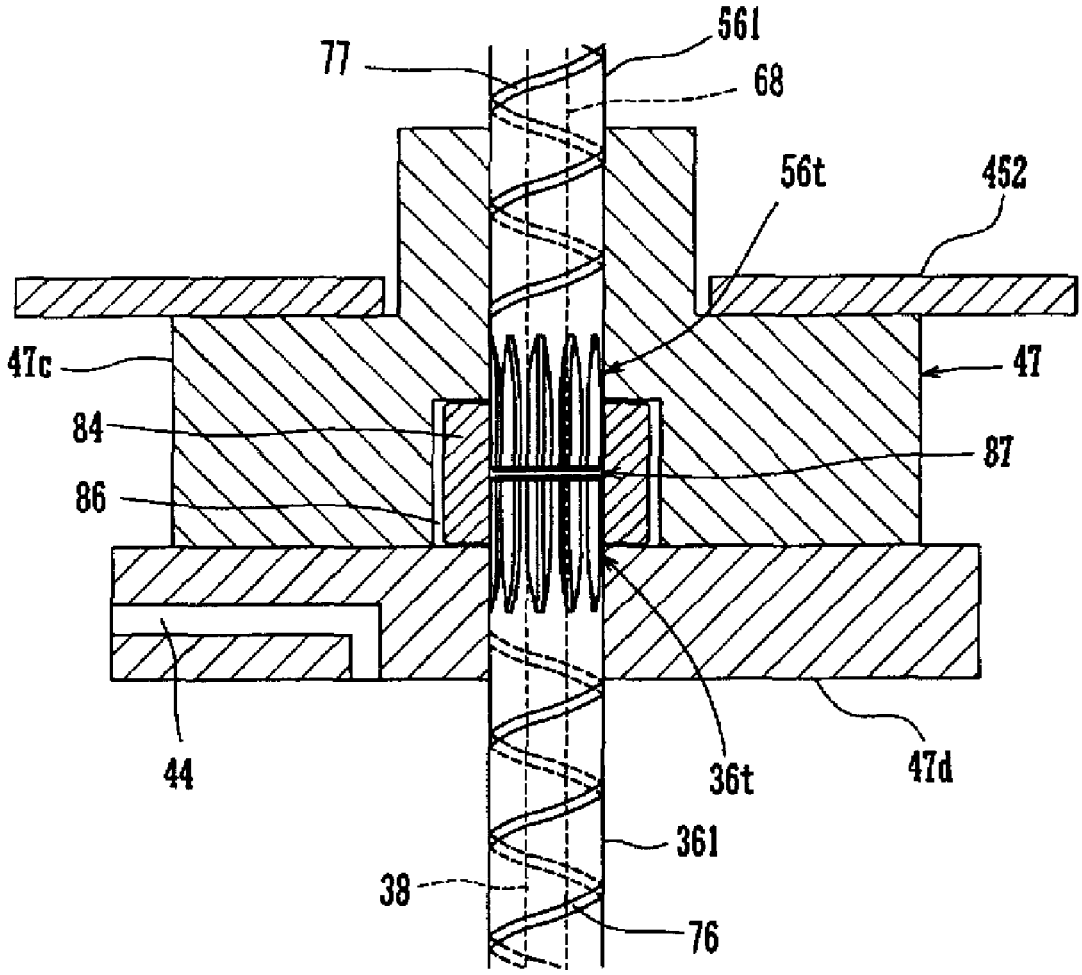
FIG. 21 is a vertical cross-sectional view of a coupling part of rotating shafts in a fluid machine according to a modified example.

In the embodiment of FIG. 14, the oil supply passage 38 is provided in the second rotating shaft 361 and the oil supply passage 68 is provided in the first rotating shaft 561. The lubricating oil in the oil reservoir 15 is pumped up to the oil supply passages 38 and 68 by the oil pump 37, allowed to pass through the oil supply ports (the oil supply ports 64, 88, etc.) communicated with the oil supply passages 38 and 68, and supplied to various sliding parts in the expansion mechanism 220 and the compression mechanism 21. However, the supply passages of the lubricating oil to various sliding parts are not limited to this example. For example, in addition to the oil supply passages 38 and 68 in the rotating shafts 361 and 561, spiral shaped oil supply grooves 76 and 77 may be formed in the outer circumferential surfaces of the two rotating shafts 361 and 561, as illustrated in FIG. 21, so that the lubricating oil can be pumped up by the oil supply grooves 76 and 77.

Figure 22:
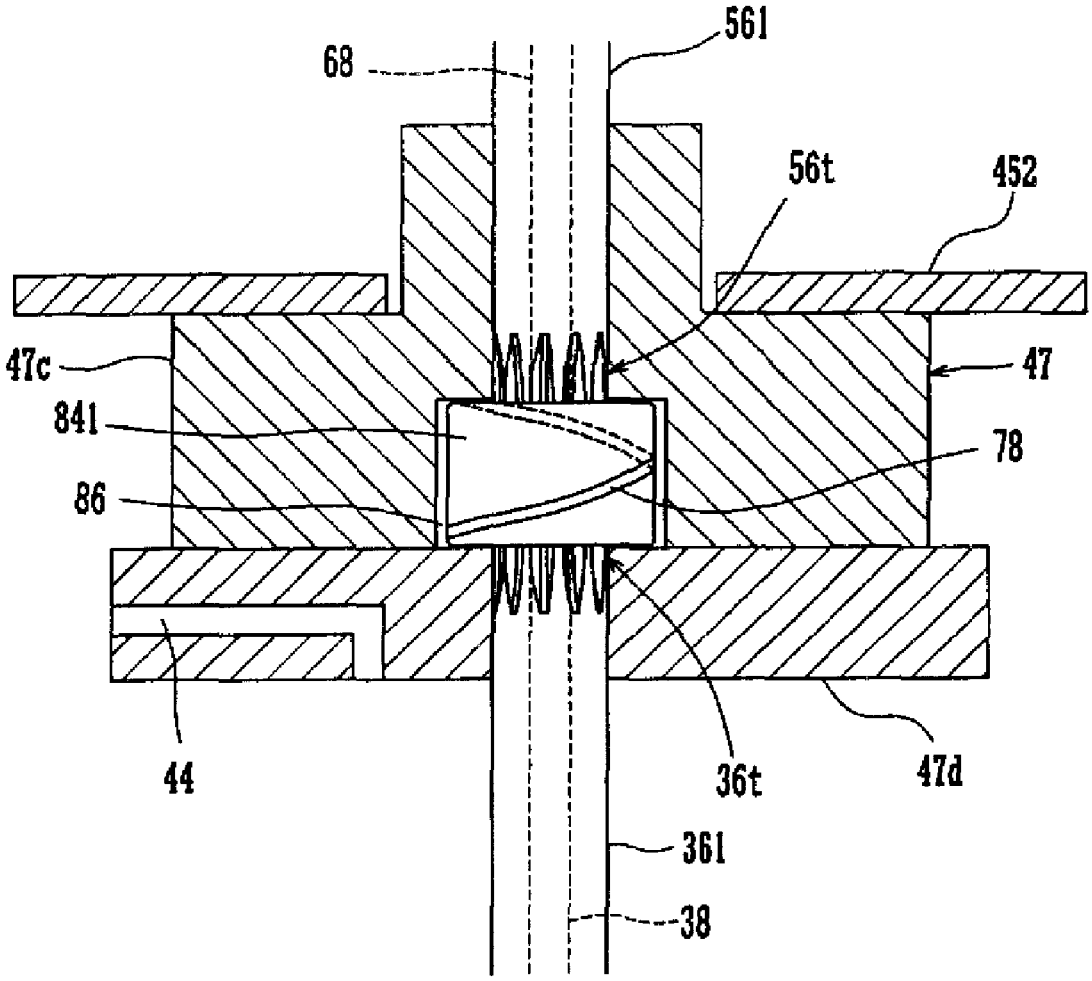
FIG. 22 is a vertical cross-sectional view of a coupling part of rotating shafts in a fluid machine according to a modified example.

Moreover, a coupling member 841 in which a spiral shaped oil supply groove 78 is formed in the outer circumferential surface thereof also may be used suitably, as illustrated in FIG. 22.

Figure 23:
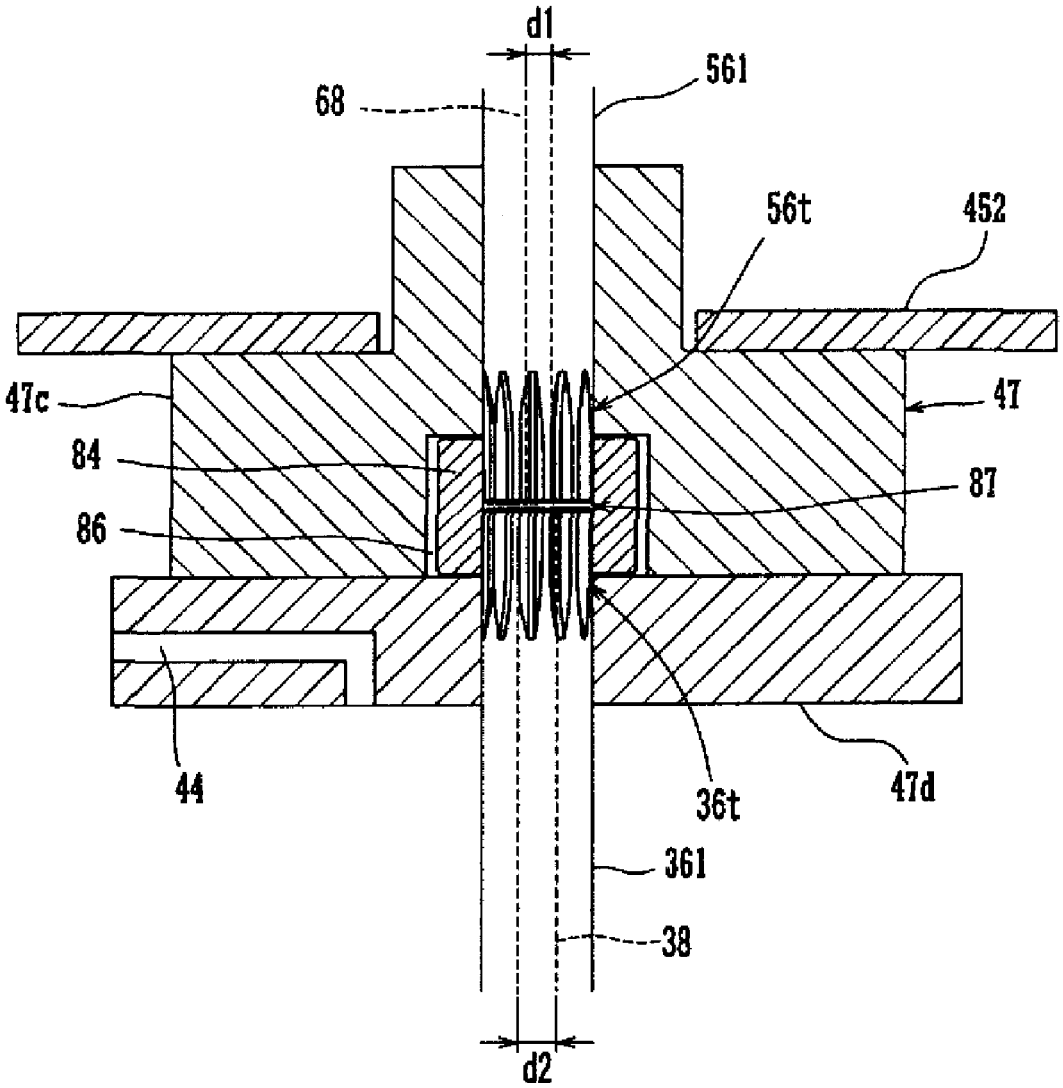
FIG. 23 is a vertical cross-sectional view of a coupling part of rotating shafts in a fluid machine according to a modified example.

It should be noted that in the foregoing embodiment of FIG. 14, the inner diameter of the oil supply passage 38 and that of the oil supply passage 68 are designed to be equal to each other. However, the inner diameter of the oil supply passage 38 and that of the oil supply passage 68 need not be equal. For example, as illustrated in FIG. 23, the inner diameter d1 of the oil supply passage 68 of the first rotating shaft 561 may be smaller than the inner diameter d2 of the oil supply passage 38 of the second rotating shaft 361. In that case, the flow passage of lubricating oil becomes suddenly narrow before the oil supply passage 68 of the first rotating shaft 561, raising the hydraulic pressure inside the coupling member 84. This makes it possible to prevent a gas from contaminating the interior of the coupling member 84 and to supply the lubricating oil stably. It should be noted that in order to further prevent a gas from contaminating the lubricating oil, it is possible to press-fit the first rotating shaft 561 into the coupling member 84. This also lessens the oil leak from the gap between the coupling member 84 and the first rotating shaft 561.

Figure 24:
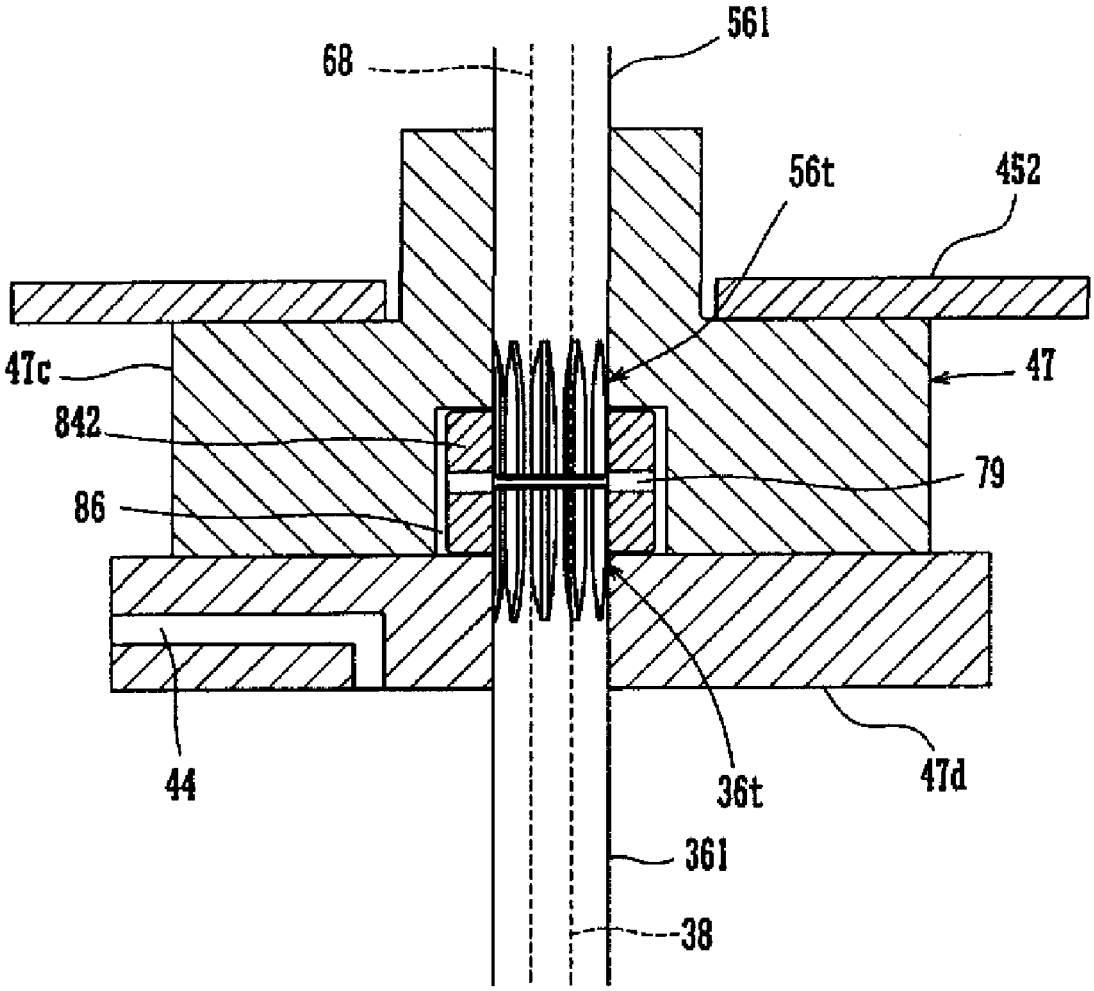
FIG. 24 is a vertical cross-sectional view of a coupling part of rotating shafts in a fluid machine according to a modified example.

As illustrated in FIG. 24, it is possible to use a coupling member 842 provided with through holes 79 each extending in a direction crossing the axis direction (in a direction perpendicular to the axis direction in FIG. 24) suitably. In this case, the lubricating oil inside the coupling member 842 receives a centrifugal force and is scattered toward the outer circumferential side through the through holes 79. As a result, the lubricating oil is filled between the coupling member 842 and the upper bearing 47 sufficiently. Therefore, the contamination of the lubricating oil by a gas can be prevented further.

Figure 25:
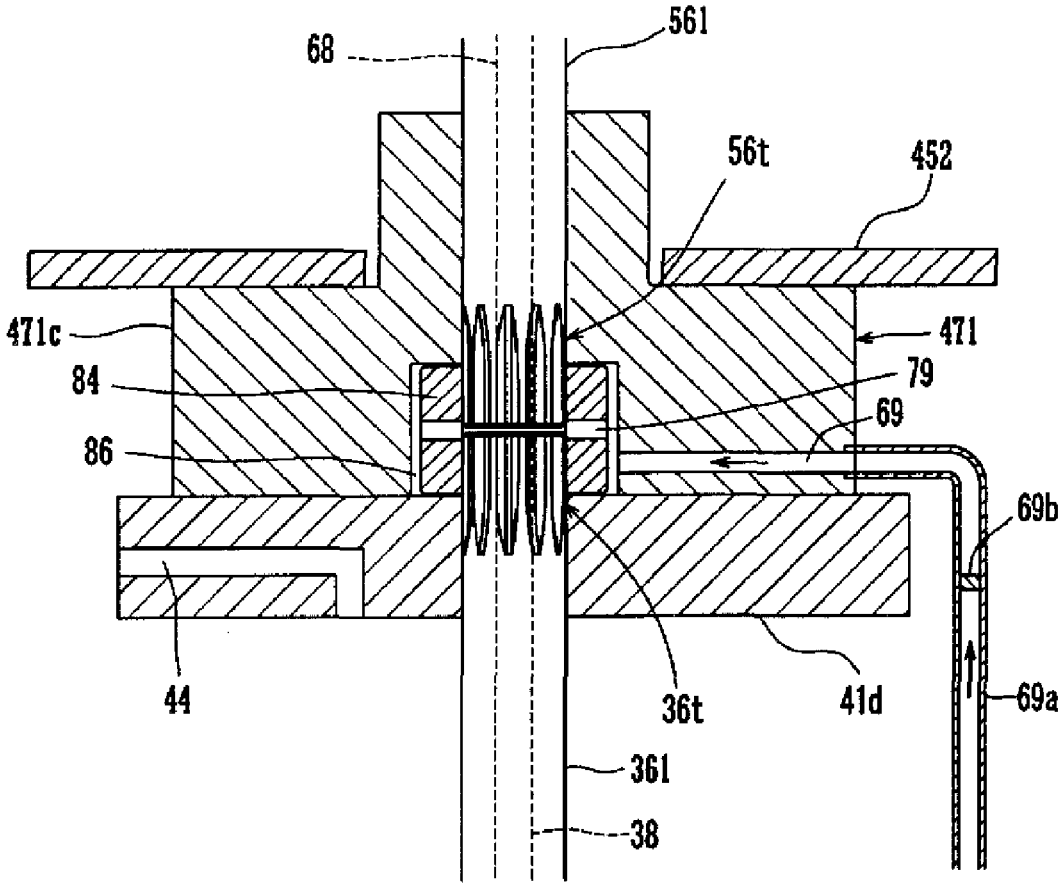
FIG. 25 is a vertical cross-sectional view of a coupling part of rotating shafts in a fluid machine according to a modified example.

Furthermore, as illustrated in FIG. 25, it is possible to use an upper bearing 471 having a first bearing member 471*c* provided with an oil supply passage 69 for supplying lubricating oil toward the outer circumferential side of the coupling member 84 suitably. It is also possible to provide an external oil supply passage 69*a* supplying lubricating oil to the oil supply passage 69 additionally. Thereby, a sufficient amount of lubricating oil can be supplied between the coupling member 84 and the upper bearing 471. It should be noted that it is preferable to provide a filter 69*b* in the interior of the external oil supply passage 69*a*. This makes it possible to supply cleaner lubricating oil between the coupling member 84 and the upper bearing 471.

In the configuration shown in FIG. 25, the lubricating oil first is supplied to the recessed portion 86 through the oil supply passage 69 of the first bearing member 471*c*. The lubricating oil guided to the recessed portion 86 further is guided through the through holes 79 of the coupling member 84 to the oil supply passage 38 and/or the oil supply passage 68 of the shaft(s). Thereby, a sufficient amount of lubricating oil can be supplied not only to between the coupling member 84 and the upper bearing 471 but also to various rotating mechanisms. The lubricating oil guided into the recessed portion 86 does not become stagnant but always circulates, and therefore it is possible to supply more proper lubricating oil to various rotating mechanisms.

Figure 26:
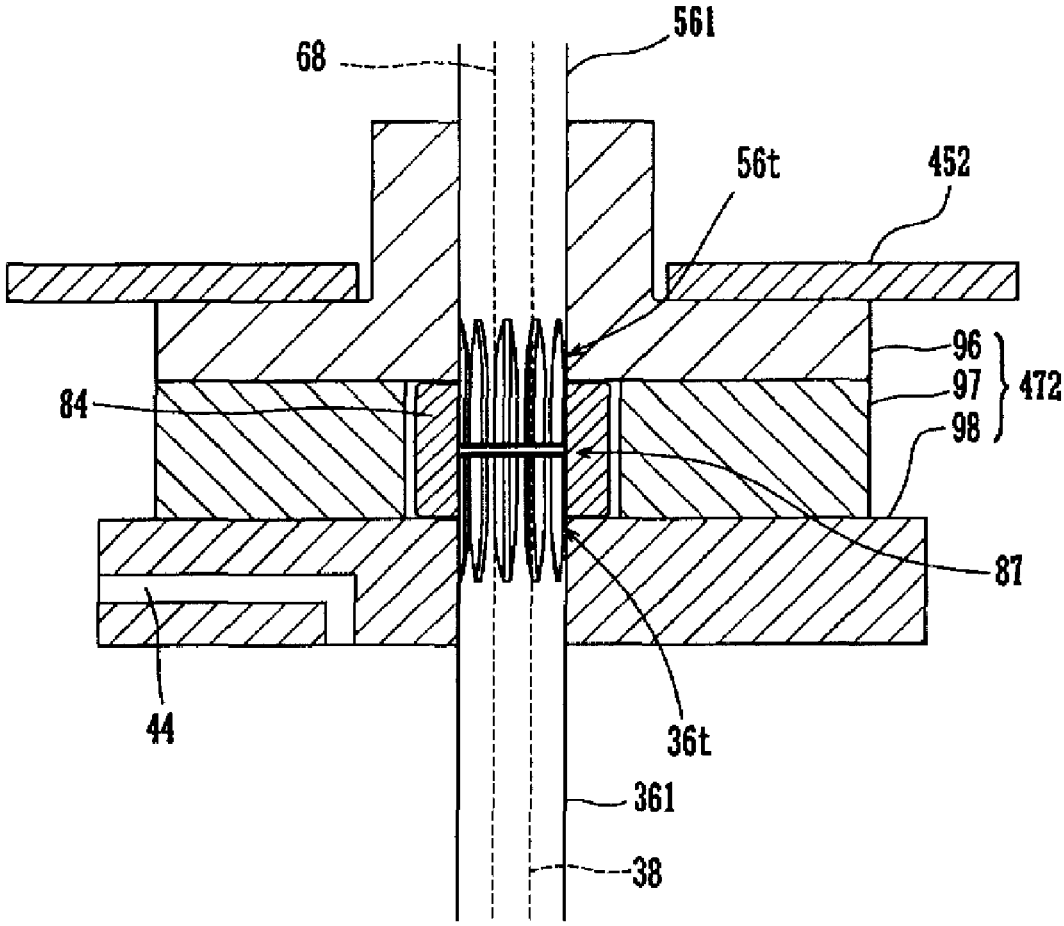
FIG. 26 is a vertical cross-sectional view of a coupling part of rotating shafts in a fluid machine according to a modified example.
Figure 27:
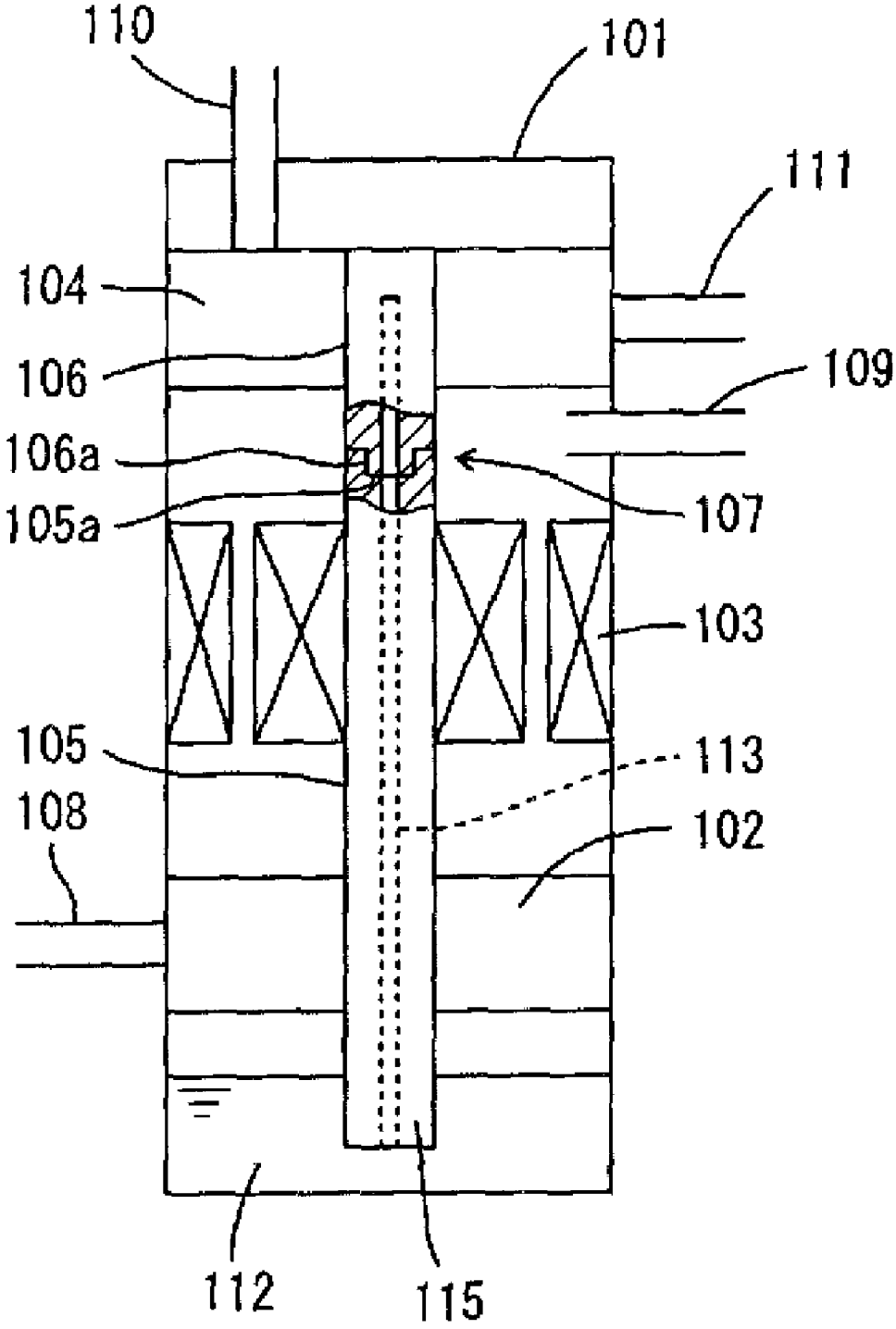
FIG. 27 is a schematic view of a conventional fluid machine.

In the embodiment of FIG. 14, the upper bearing 47 includes the first bearing member 47*c* for supporting the first rotating shaft 561 and covering the circumference of the coupling member 84 and the second bearing member 47*d* for supporting the second rotating shaft 361. However, the configuration of the upper bearing 47 is not limited to this example. For example, an upper bearing 472 shown in FIG. 26 includes a first bearing member 96 for supporting the first rotating shaft 561, a sealing member 97 for covering the circumference of the coupling member 84, and a second bearing member 98 for supporting the second rotating shaft 361. The first bearing member 96, the sealing member 97, and the second bearing member 98 are assembled in that order along the axis direction of the rotating shafts 361 and 561. Thus, by assembling the first bearing member 96 above the sealing member 97 after inserting the coupling member 84 into the sealing member 97 and assembling the second bearing member 98 below the sealing member 97, the coupling member 84 can be disposed easily in the interior of the upper bearing 472. Thus, according to such an embodiment, it becomes possible to prevent the oil leak at the coupling part 87 and so forth by a simple assembling work.

Some of the configurations that have been described as the other embodiments in the cases that the two rotating shafts are coupled directly to each other may be employed also in the cases that the rotating shafts are coupled to each other using a coupling member as long as they fall within the scope of the present invention. For example, the combinations of a plurality of rotating mechanisms, the position relationships of the compression mechanism and the expansion mechanism, and so forth may also be as described previously.

As has been described above, the present invention is useful for a fluid machine furnished with a plurality of rotating mechanisms including a compression mechanism for compressing fluid or an expansion mechanism for expanding fluid. For example, the invention is useful for a compressor, an expander, an expander-compressor unit, and the like provided in a refrigerant circuit of a refrigeration apparatus, an air conditioner, a hot water heater, and the like.

The invention claimed is:

1. A fluid machine comprising:

a first rotating mechanism comprising a compression mechanism for compressing a fluid or an expansion mechanism for expanding fluid, the compression mechanism and the expansion mechanism having a first rotating shaft in which a first oil supply passage extending axially is formed;

a second rotating mechanism comprising a compression mechanism for compressing a fluid or an expansion mechanism for expanding a fluid, the compression mechanism and the expansion mechanism having a second rotating shaft in which a second oil supply passage extending axially is formed, the second rotating shaft being coupled linearly to the first rotating shaft such that lubricating oil is allowed to flow through the first oil supply passage and the second oil supply passage and a gap is present in a coupling part of the first and second rotating shafts;

a closed casing for accommodating the first and second rotating mechanism; and a bearing for supporting both the first and second rotating shafts, and covering a circumference of the gap in the coupling part of the first rotating shaft and the second rotating shaft in the closed casing, the bearing being fixed to the inner wall of the closed casing and the first and second rotating shafts being rotatable relative to the bearing, wherein the bearing comprises a single bearing member supporting both the first and second rotating shafts;

wherein the first rotating shaft and the second rotating shaft are separate members from eachother; and wherein a first sliding part is disposed between the bearing and the first rotating shaft, and a second sliding part is disposed between the bearing and the second rotating shaft the gap in the coupling part of the first and second rotating shafts allowing lubricating oil to exit from the gap and be supplied to the sliding parts to lubricate and seal the sliding parts.

2. The fluid machine according to claim 1, wherein the bearing is one of the components of the first or second rotating mechanism.

3. The fluid machine according to claim 1, wherein the bearing is separated from the first and second rotating mechanisms.

4. The fluid machine according to claim 1, wherein:

the first rotating mechanism and the second rotating mechanism are arranged along the longitudinal direction of the closed casing;

a discharge pipe, one end of which is open toward an internal space of the closed casing, is connected to a portion of the closed casing that is nearer one end thereof with respect to the longitudinal center point of the closed casing; and the coupling part of the first rotating shaft and the second rotating shaft is provided nearer the other end of the closed casing with respect to the longitudinal center point thereof.

5. The fluid machine according to claim 1, wherein the first rotating shaft and the second rotating shaft have different outer diameters.

6. The fluid machine according to claim 1, wherein:

a first engaging portion is formed at the first rotating shaft;

a second engaging portion is formed at the second rotating shaft, the second engaging portion engaging with the first engaging portion; and the first engaging portion and the second engaging portion are engaged with each other, whereby the first rotating shaft and the second rotating shaft are coupled to each other.

7. The fluid machine according to claim 6, wherein:

one of the first and second engaging portions comprises a shaft portion having a polygonal-shaped outer circumferential contour in cross section; and the other one of the first and second engaging portions comprises a boss portion having a polygonal-shaped inner circumferential contour in cross section that corresponds to the polygonal-shaped outer circumferential contour of the shaft portion.

8. The fluid machine according to claim 6, wherein:

one of the first and second engaging portions comprises a shaft portion in which a plurality of grooves are formed in its outer circumferential side; and the other one of the first and second engaging portions comprises a boss portion in which a plurality of grooves corresponding to the grooves of the shaft portion are formed in its inner circumferential side.

9. The fluid machine according to claim 1, wherein a groove that forms an oil reservoir space covering the coupling part of the first rotating shaft and the second rotating shaft is formed in an inner circumferential side of the bearing, an outer circumferential side of the first rotating shaft or an outer circumferential side of the second rotating shaft.

10. The fluid machine according to claim 1, wherein:

one of the first and second rotating mechanisms comprises a compression mechanism; and the other one of the first and second rotating mechanisms comprises an expansion mechanism.

11. The fluid machine according to claim 1, wherein:

the first and second rotating shafts extend vertically;

the second rotating mechanism is disposed below the first rotating mechanism;

an oil reservoir for holding lubricating oil is formed in a bottom portion of the closed casing; and the coupling part of the first rotating shaft and the second rotating shaft is provided at a lower position than a vertical center point of an entirety of the two rotating shafts.

12. The fluid machine according to claim 11, wherein:

the first rotating mechanism comprises a compression mechanism; and the second rotating mechanism comprises an expansion mechanism.

13. A refrigeration cycle apparatus comprising:

an expander-compressor unit comprising a compression mechanism for compressing a refrigerant, a motor for supplying mechanical power to the compression mechanism, an expansion mechanism for expanding the refrigerant, and a shaft for coupling the compression mechanism and the expansion mechanism;

a radiator for cooling the refrigerant; and an evaporator for evaporating the refrigerant, wherein the expander-compressor unit is constituted by a fluid machine according to claim 1 in which the first rotating mechanism is the compression mechanism and the second rotating mechanism is the expansion mechanism.

14. The fluid machine according to claim 1, wherein a spiral shaped oil supply groove is formed in an inner circumferential surface of the bearing.

15. The fluid machine according to claim 1, wherein the first and second rotating shaft perform rotational movement relative to the bearing.

* * * * *